US011128039B2

(12) United States Patent
Lavin et al.

(10) Patent No.: US 11,128,039 B2
(45) **Date of Patent: *Sep. 21, 2021**

(54) CAVITY ANTENNA WITH RADOME

(71) Applicant: The Boeing Company, Chicago, IL (US)

(72) Inventors: Ronald O. Lavin, Gilbert, AZ (US); Dennis K. McCarthy, Gilbert, AZ (US); Andy H. Lee, Phoenix, AZ (US); Manny S. Urcia, Wildwood, MO (US)

(73) Assignee: The Boeing Company, Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/837,281

(22) Filed: Apr. 1, 2020

(65) Prior Publication Data

US 2020/0287279 A1 Sep. 10, 2020

Related U.S. Application Data

(62) Division of application No. 15/846,307, filed on Dec. 19, 2017, now Pat. No. 10,644,391.

(51) Int. Cl.

| | |
|---|---|
| ***H01Q 1/42*** | (2006.01) |
| ***H01Q 7/00*** | (2006.01) |
| ***H01Q 9/04*** | (2006.01) |

(52) U.S. Cl.

CPC ..... *H01Q 1/422* (2013.01); *H01Q 1/42* (2013.01); *H01Q 7/00* (2013.01); *H01Q 9/0485* (2013.01)

(58) Field of Classification Search

CPC ..... H01Q 1/40; H01Q 1/405; H01Q 1/42; H01Q 1/421; H01Q 1/422; H01Q 1/424; H01Q 1/425; H01Q 1/427; H01Q 1/428; H01Q 13/18; H01Q 7/00; H01Q 9/0485

See application file for complete search history.

(56) References Cited

U.S. PATENT DOCUMENTS

| | | | | |
|---|---|---|---|---|
| 3,795,559 | A | 3/1974 | Horn et al. | |
| 4,733,245 | A * | 3/1988 | Mussler | H01Q 19/09 343/769 |
| 7,998,299 | B2 | 8/2011 | McCarville et al. | |
| 10,644,391 | B2 * | 5/2020 | Lavin | H01Q 9/0485 |
| 2017/0301980 | A1 | 10/2017 | Lavin et al. | |
| 2017/0302006 | A1 | 10/2017 | Lavin et al. | |

* cited by examiner

*Primary Examiner* — Robert Karacsony
(74) *Attorney, Agent, or Firm* — Walters & Wasylyna LLC

(57) ABSTRACT

A method for designing an antenna including defining an operating frequency of an antenna radiating element located within an antenna cavity structure; determining a non-loaded depth of the antenna cavity structure; determining a reduced depth of the antenna cavity structure; determining a reduction factor to reduce the non-loaded depth to the reduced depth; and selecting a dielectric material, at least partially forming a radome structure covering the antenna radiating element, to achieve the reduction factor.

20 Claims, 13 Drawing Sheets

CAVITY ANTENNA WITH RADOME

PRIORITY

This application is a divisional of U.S. Ser. No. 15/846,307 filed on Dec. 19, 2017.

GOVERNMENT RIGHTS

This invention was made with government support under Technology Investment Agreement No. W911W6-16-2-0003 awarded by the Department of Defense. The government has certain rights in this invention.

FIELD

The present disclosure is generally related to antennas and, more particularly, to methods of designing and making a cavity-backed antenna with radome.

BACKGROUND

Many modern vehicles utilize antenna systems to transmit and/or receive radio waves, for example, for wireless communications and/or radar. Typically, an antenna is installed on an exterior of the vehicle. Many antenna systems that utilize an exterior-mounted antenna also include a radome or other enclosure that covers the radiating element of the antenna and protects the antenna from exposure to the environment. Many antenna systems also include a cavity structure that defines a resonance cavity located behind the radiating element of the antenna. The cavity enforces unidirectional radiation from the antenna. Among other factors, the dimensions of the cavity and, thus, the size of the antenna primarily depend on the operating frequency of the antenna.

In certain applications, such as in aerospace and electronic, the size of the antenna cavity is a significant design constraint. One solution to reduce the size of the cavity is to fill the cavity with a dielectric loading mechanism, also referred to as loading the cavity. However, this reduction in size typically comes at the expense of increased weight, which is another significant design constraint in many applications.

Accordingly, those skilled in the art continue with research and development efforts in the field of cavity-backed antennas.

SUMMARY

In an example, the disclosed antenna includes an antenna cavity structure that defines an antenna cavity and that has a cavity opening. The antenna also includes an antenna radiating element located within the cavity opening and operable to emit electromagnetic radiation that has a frequency and a wavelength and a radome structure covering the cavity opening. The radome structure includes a dielectric material and defines an antenna window that is transparent to the electromagnetic radiation. The antenna cavity has a depth and the depth of the antenna cavity is less than one-fourth of the wavelength of the electromagnetic radiation.

In an example, the disclosed antenna system includes an antenna cavity structure that defines an antenna cavity and that has a cavity opening. The antenna system also includes an antenna radiating element located within the cavity opening and operable to emit electromagnetic radiation that has a frequency and a wavelength and a radome structure covering the cavity opening. The radome structure includes a dielectric material and defines an antenna window that is transparent to the electromagnetic radiation. The antenna cavity has a depth and the depth of the antenna cavity is less than one-fourth of the wavelength of the electromagnetic radiation.

In another example, the disclosed method includes steps of: (1) defining an operating frequency of an antenna radiating element located within an antenna cavity structure; (2) determining a non-loaded depth of the antenna cavity structure; (3) determining a reduced depth of the antenna cavity structure; (4) determining a reduction factor to reduce the non-loaded depth to the reduced depth; and (5) selecting a dielectric material, at least partially forming a radome structure covering the antenna radiating element, to achieve the reduction factor.

In another example, the disclosed method includes steps of: (1) locating an antenna radiating element within a cavity opening of an antenna cavity structure, wherein the antenna radiating element is operable to emit electromagnetic radiation that has at least one wavelength; (2) covering the cavity opening of the antenna cavity structure with a radome structure that has an antenna window for passage of the electromagnetic radiation, wherein the radome structure comprises a foam core and a dielectric material distributed through at least a portion of the foam core; and (3) electromagnetically coupling the radome structure with the antenna radiating element such that the antenna radiating element is dielectrically loaded by the radome structure and a depth of the antenna cavity structure is less than one-fourth of the at least one wavelength of the electromagnetic radiation emitted by the antenna radiating element.

In yet another example, the disclosed method includes steps of: (1) locating an antenna radiating element within a cavity opening of an antenna cavity structure, wherein the antenna radiating element is operable to emit electromagnetic radiation that has at least one wavelength; (2) coupling a radio module to the antenna radiating element; (3) covering the cavity opening of the antenna cavity structure with a radome structure that has an antenna window for passage of the electromagnetic radiation, wherein the radome structure comprises a foam core and a dielectric material distributed through at least a portion of the foam core; (4) electromagnetically coupling the radome structure with the antenna radiating element such that the antenna radiating element is dielectrically loaded by the radome structure and a depth of the antenna cavity structure is less than one-fourth of the at least one wavelength of the electromagnetic radiation emitted by the antenna radiating element; and (5) coupling the radome structure to at least one of a plurality of panels to form a skin of the vehicle.

Other embodiments and/or examples of the disclosed antenna and method will become apparent from the following detailed description, the accompanying drawings and the appended claims.

DETAILED DESCRIPTION

Figure 1:
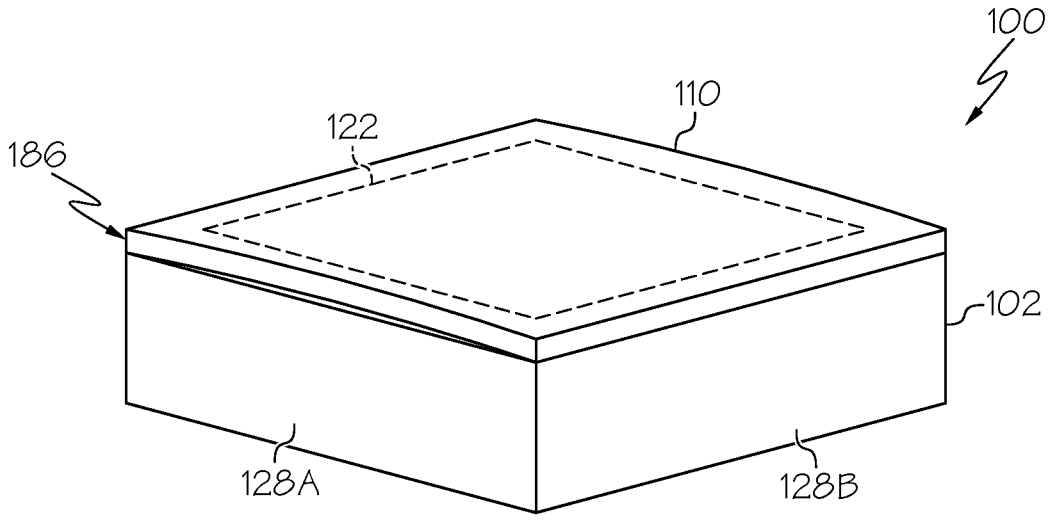
FIG. 1 is a schematic, perspective view of an example of a disclosed antenna.

The following detailed description refers to the accompanying drawings, which illustrate specific embodiments and/or examples described by the disclosure. Other embodiments and/or examples having different structures and operations do not depart from the scope of the present disclosure. Like reference numerals may refer to the same feature, element or component in the different drawings.

Illustrative, non-exhaustive examples, which may be, but are not necessarily, claimed, of the subject matter according the present disclosure are provided below.

The present disclosure recognizes and takes into account that in order for a cavity-backed antenna to properly and efficiently operate within a given frequency band, a depth dimension of a cavity is defined based on an operating frequency, or frequencies, of the antenna's radiating element, which is located within the cavity. For example, the depth dimension of a cavity that is filled with air, referred to as an air-filled cavity, needs to be at least one-fourth (¼) of a wavelength of the electromagnetic radiation emitted by the antenna's radiating element. In an illustrative example, an antenna that has an operating frequency of approximately 300 MHz has a wavelength of approximately one (1) meter (approximately forty (40) inches). Thus, in this example, the depth dimension of the air-filled cavity needs to be approximately ten (10) inches.

The present disclosure also recognizes and takes into account that a reduction in the depth dimension of the cavity and, thus, the size of the cavity-backed antenna can be achieved by filling the cavity with a dielectric loading mechanism, such as a dielectric material or a ferrite material, referred to as a loading material. For example, the depth dimension of a cavity filled with a loading material, referred to as a loaded cavity, can generally be reduced by a factor, referred to herein as reduction factor ($F_R$) equal to the inverse of a square root of the product of the relative permittivity ($\varepsilon_r$) of the loading material and the relative permeability ($\mu_r$) of the loading material [$F=1/\sqrt{(\varepsilon_r*\mu_r)}$]. In an illustrative example, the depth dimension of a loaded cavity used with an antenna that has an operating frequency of approximately 300 MHz can be reduced from approximately ten (10) inches to approximately four (4) inches when the cavity is filled with a loading material having a product of relative permittivity and relative permeability of approximately 6.25.

As used herein, the term permittivity has its ordinary meaning known to those skilled in the art and includes the measure of resistance that is encountered when forming an electric field in a particular material. Relative permittivity of a material is its (absolute) permittivity expressed as a ratio relative to the permittivity of vacuum. Relative permittivity is also commonly known as dielectric constant. As used herein, the term permeability has its ordinary meaning known to those skilled in the art and includes the measure of the ability of a material to support the formation of a magnetic field within itself. Relative permeability of a material is a ratio of effective permeability to absolute permeability.

The present disclosure further recognizes and takes into account that the reduction in depth of the cavity and, thus, the size of the cavity-backed antenna typically comes at the expense of weight due to the increased weight provided by the loading material that fills the cavity.

Figure 2:
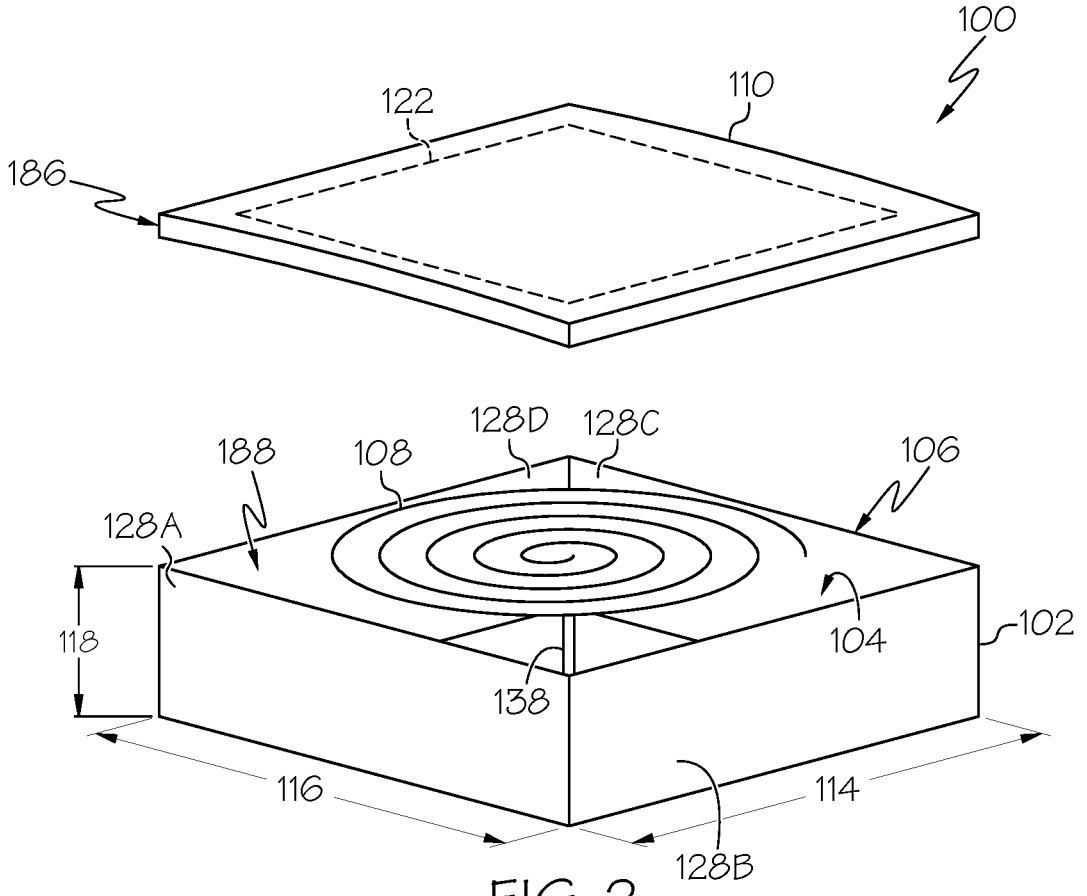
FIG. 2 is a schematic, perspective, partially exploded view of an example of the disclosed antenna.
Figure 3:
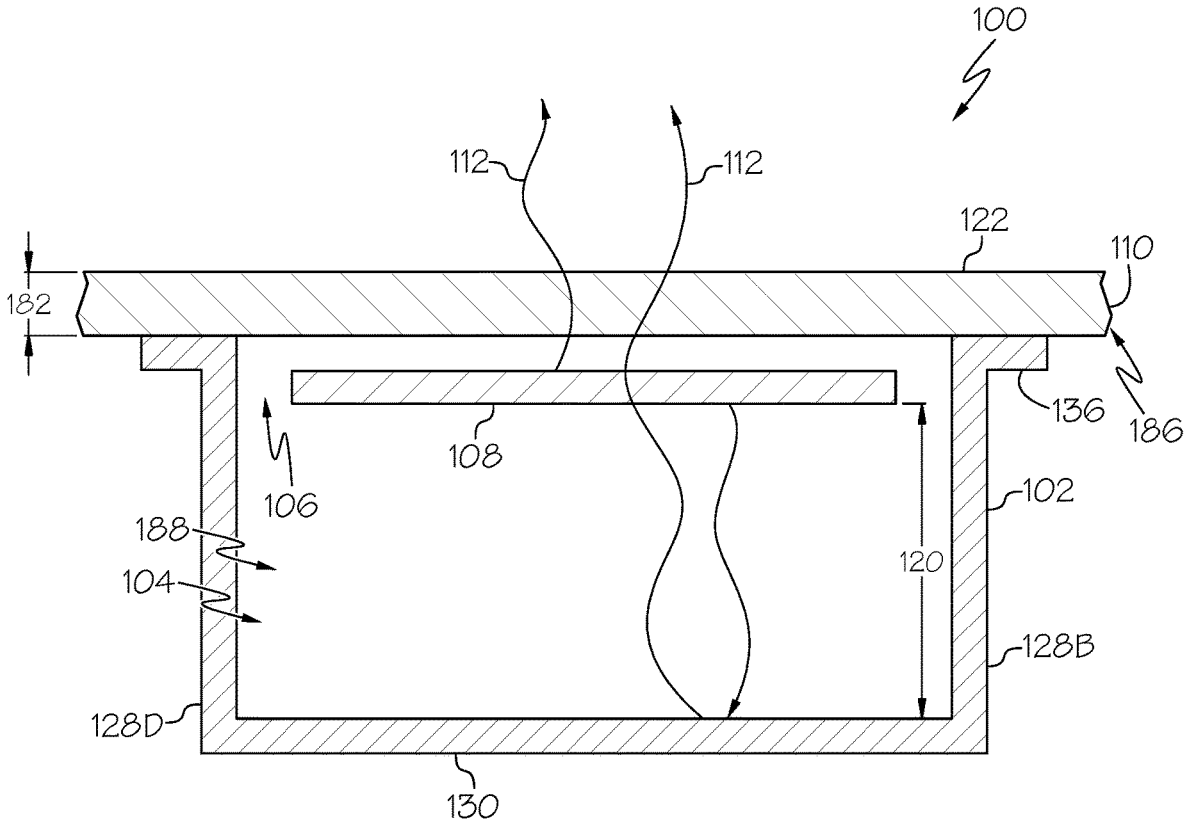
FIG. 3 is a schematic, elevation, sectional view of an example of the disclosed antenna.

Referring now, generally, to FIGS. 1-8, disclosed is a cavity-backed antenna, referred to herein as the antenna 100. The antenna 100 may also be referred to as a cavity antenna or a cavity-type antenna. The antenna 100 includes an antenna cavity structure 102. The antenna cavity 104 has a depth dimension, referred to herein as depth 120 (FIG. 3). The antenna 100 also includes an antenna radiating element 108 (FIGS. 2 and 3), located at least partially within the antenna cavity structure 102. The antenna 100 also includes a radome structure 110, covering the antenna radiating element 108. The radome structure 110 includes (e.g., is at least partially formed of) a dielectric material 186.

Thus, in addition to protecting the antenna radiating element 108 from exposure to the environment, the radome structure 110 serves as the dielectric loading mechanism of the antenna 100 and locates the dielectric loading mechanism of the antenna 100 at an exterior of the antenna cavity structure 102, rather than within the antenna cavity structure 102. As will be further described herein, locating the dielectric loading mechanism of the antenna 100 outside of the antenna cavity structure 102 enables a reduction in the depth 120 of the antenna cavity structure 102 and, thus, the size of the antenna 100, and enables a reduction in the weight of the antenna 100.

Referring to FIGS. 1-3, in an example of the disclosed antenna 100, the antenna cavity structure 102 defines an antenna cavity 104 (FIGS. 2 and 3) and has a cavity opening 106 (FIG. 2). The antenna radiating element 108 is located within the cavity opening 106 of the antenna cavity structure 102. The antenna radiating element 108 is operable to emit electromagnetic radiation 112 (FIG. 3) that has a frequency and a wavelength (as a function of the frequency). The depth 120 of the antenna cavity 104 is less than one-fourth (¼) of the wavelength of the electromagnetic radiation 112 emitted by the antenna radiating element 108.

The dielectric material 186 forming the radome structure 110 serves as the dielectric loading mechanism that enables the depth 120 of the antenna cavity 104 to be less than approximately one-fourth (¼) of the wavelength of the electromagnetic radiation 112 emitted by the antenna radiating element 108. The depth 120 of the antenna cavity 104 being less than one-fourth (¼) of the wavelength of the electromagnetic radiation 112 represents a reduction in size, and a corresponding reduction in the associated space required for installation of the antenna 100, as compared to a traditional air-filled cavity-backed antenna.

In an example, the presence of the dielectric radome structure 110 (covering the antenna radiating element 108 and the cavity opening 106 of the antenna cavity structure 102) enables utilization of the antenna cavity structure 102 having the antenna cavity 104 with depth 120 being between approximately one-fourth (¼) (e.g., exclusive of one-fourth (¼)) of the wavelength of the electromagnetic radiation 112 and approximately one-sixteenth (1/16) (e.g., inclusive or exclusive of one-sixteenth (1/16)) of the wavelength of the electromagnetic radiation 112. In an example, the presence of the dielectric radome structure 110 enables utilization of the antenna cavity structure 102 having the antenna cavity 104 with depth 120 being between approximately one-eighth (⅛) (e.g., inclusive or exclusive of one-eighth (⅛)) of the wavelength of the electromagnetic radiation 112 and approximately one-sixteenth (1/16) (e.g., inclusive or exclusive of one-sixteenth (1/16)) of the wavelength of the electromagnetic radiation 112. In an example, the presence of the dielectric radome structure 110 enables utilization of the antenna cavity structure 102 having the antenna cavity 104 with depth 120 being between approximately one-tenth (1/10) (e.g., inclusive or exclusive of one-tenth (1/10)) of the wavelength of the electromagnetic radiation 112 and approximately one-sixteenth (1/16) (e.g., inclusive or exclusive of one-sixteenth (1/16)) of the wavelength of the electromagnetic radiation 112. In an example, the presence of the dielectric radome structure 110 enables utilization of the antenna cavity structure 102 having the antenna cavity 104 with depth 120 being approximately one-tenth (1/10) of the wavelength of the electromagnetic radiation 112.

As used herein, dielectric has its ordinary meaning known to those skilled in the art and includes an electrical insulator that can be polarized by an applied electric field. A dielectric material is a material with a high polarizability, expressed by relative permittivity (i.e., as a dielectric constant). In various examples, the relative permittivity (the dielectric constant) and/or the relative permeability of the material to be used as the dielectric material 186 is selected to achieve a desired reduction factor ($F_R$) for the depth 120 of the antenna cavity structure 102 based on the operating frequency of the antenna radiating element 108. In some examples, the dielectric material 186 has no magnetic properties, thus the relative permeability of the dielectric material 186 is one (1).

In an illustrative example, a selected dielectric material 186 having a dielectric constant of 6.25 results in a reduction factor of approximately 0.4 [$F_R=1/\sqrt{(6.25*1)}=0.4$]. Thus, in this example, the depth 120 of the antenna cavity 104, used with the antenna radiating element 108 that has an operating frequency of approximately 300 MHz, is reduced from approximately ten (10) inches to approximately four (4) inches, or to approximately one-tenth (1/10) of a wavelength of the electromagnetic radiation 112.

Thus, covering the cavity opening 106 of the antenna cavity structure 102 with the radome structure 110 locates the dielectric loading mechanism at the exterior of the antenna cavity structure 102, which enables the antenna cavity 104 to be filled with a very lightweight material, such as air, vacuum or a lightweight foam. In an example, filling the antenna cavity 104 with air, or another very lightweight material, represents a significant reduction in weight of the antenna 100 as compared to a traditional cavity-backed antenna having a similar depth that is stuffed or filled with a loading material (e.g., dielectric material or ferrite tiles), which serve as the dielectric loading mechanism.

Further, locating the dielectric loading mechanism in the radome structure 110 and positioning the radome structure 110 at the exterior of the antenna cavity structure 102 enables the radome structure 110, and the dielectric loading mechanism, to be significantly thinner and/or lighter in weight than the thickness and/or weight of the loading material that fills the cavity of a traditional stuffed cavity-backed antenna. As will be further described herein, in some example, the radome structure 110 includes (is formed from) a sandwich structure of material layers that can be tailored to have the relative permittivity and/or the relative permeability needed to achieve the desired reduction factor on the depth 120 (FIG. 3) of the antenna cavity structure 102. Thus, the radome structure 110 can be constructed to be thinner and lighter than the mass of bulk loading material used to fill the traditional cavity-backed antenna.

As shown in FIG. 3, the radome structure 110 has a thickness dimension, referred to herein as thickness 182. The thickness 182 of the radome structure 110 can vary depending upon numerous factors including, but not limited to, the materials used to form the radome structure 110 and the desired reduction factor of the depth 120 of the antenna cavity structure 102. Those skilled in the art will also recognize that the number and/or type of material layers, the thickness of the radome structure 110 and/or one or more of the material layers of the sandwich structure, and/or the dielectric materials used to form the radome structure 110 and/or one or more of the material layers of the sandwich structure may also be based on other factors including, but not limited to, the pass band, the attenuation loss required of the radome structure 110 and/or the strength requirements of the radome structure 110. In some examples, the thickness 182 of the radome structure 110 is constant. In some examples, the thickness 182 of the radome structure 110 varies, for example, along one or more lateral directions. For example, the thickness 182 of the radome structure 110 may taper from a central region toward one or more perimeter edges of the radome structure 110. Among other factors, variations in the thickness 182 of the radome structure 110 may affect the transmission characteristics of the electromagnetic radiation 112 passing through the radome structure 110.

In an example, and as best illustrated in FIG. 3, locating the antenna radiating element 108 within the cavity opening 106 positions the antenna radiating element 108 at least partially within the antenna cavity 104 of the antenna cavity structure 102. In this configuration, the presence of the antenna cavity structure 102 enforces unidirectional radiation of the electromagnetic radiation 112, for example, directs the electromagnetic radiation 112 in a desired direction outward from the antenna cavity structure 102 and through the radome structure 110. In some examples, the electromagnetic radiation 112 emitted or received by the antenna radiating element 108 takes the form of electromagnetic waves, radio waves or radio signals.

The radome structure 110 covers the opening 106 of the antenna cavity structure 102. In an example, the radome structure 110 is positioned in front of the antenna radiating element 108 such that the radome structure 110 is located in the path of the electromagnetic radiation 112 (FIG. 3) transmitted and/or received by the antenna radiating element 108. The radome structure 110 defines an antenna window 122 (depicted with broken lines in FIGS. 1-2) that is transparent to the electromagnetic radiation 112. In an example, at least the antenna window 122 of the radome structure 110 is formed from the dielectric material 186.

Covering the cavity opening 106 with the radome structure 110 positions the antenna radiating element 108 behind the dielectric material 186 forming the antenna window 122 of the radome structure 110. In an example, the antenna window 122 is aligned with the antenna radiating element 108. In some examples, it is not necessary for the size of the antenna window 122 to overlap the entire cavity opening 106. In an example, the antenna window 122 has lateral (e.g., side-to-side) dimensions that are sufficient to completely or fully cover the area occupied by the antenna radiating element 108 without completely covering the area formed by the cavity opening 106. In other examples, the antenna window 122 has dimensions that are sufficient to completely or fully cover the area formed by the cavity opening 106. In some other examples, the antenna window 122 defines the entire radome structure 110. The antenna window 122 of the radome structure 110 enables the electromagnetic radiation 112 to pass between the antenna radiating element 108 and an exterior of the antenna 100, for example, from the antenna radiating element 108, through the radome structure 110, to the exterior of the antenna 100 (e.g., transmission) and/or from the exterior of the antenna 100, through the radome structure 110, to the antenna radiating element 108 (e.g., reception).

In an example, the antenna cavity structure 102 is filled with a low-dielectric material 188 (FIGS. 2 and 3). In other words, the antenna cavity 104 is filled with the low-dielectric material 188. In an example, the low-dielectric material 188 has a dielectric constant of between 1 and approximately 1.1. In another example, the low-dielectric material 188 has a dielectric constant of approximately 1.05.

In an example, the low-dielectric material 188 includes (is formed from) air. In other words, the antenna cavity 104 is filled with air. As used herein, the term "air" has its ordinary meaning as known to those skilled in the art and includes the Earth's atmosphere including a mixture of gases and, possibly, dust particles. Therefore, the antenna cavity 104 of the antenna cavity structure 102 may also be referred to as an air-filled cavity. For example, substantially all of the interior volume of the antenna cavity structure 102, which defines the antenna cavity 104, is occupied by air except for the portion of the antenna cavity 104 occupied by the antenna radiating element 108 and any other components associated with the antenna radiating element 108, such as a support structure, transmission lines and the like. In an example, the antenna cavity 104 is at least 75 percent filled with air. In another example, the antenna cavity 104 is at least 90 percent filled with air.

In an example, the low-dielectric material 188 includes (is formed from) a vacuum. In other words, the antenna cavity 104 is filled with vacuum. As used herein, the term "vacuum" has its ordinary meaning as known to those skilled in the art and includes a space devoid of matter or a region with a gaseous pressure much less than atmospheric pressure. Therefore, the antenna cavity 104 of the antenna cavity structure 102 may also be referred to as a vacuum-filled cavity. For example, substantially all of the interior volume of the antenna cavity structure 102, which defines the antenna cavity 104, is occupied by a vacuum except for the portion of the antenna cavity 104 occupied by the antenna radiating element 108 and any other components associated with the antenna radiating element 108, such as a support structure, transmission lines and the like.

In an example, the low-dielectric material 188 includes (is formed from) open-cell foam. In other words, the antenna cavity 104 is filled with open-cell foam. In an example, the open-cell foam has a dielectric constant of between 1.05 and 1.1 and a relative density of less than approximately three-quarters (¾) of a pound per cubic foot, such as less than approximately one-half (½) of a pound per cubic foot. Therefore, the antenna cavity 104 of the antenna cavity structure 102 may also be referred to as an open-cell foam-filled cavity. For example, substantially all of the interior volume of the antenna cavity structure 102, which defines the antenna cavity 104, is occupied by the open-cell foam except for the portion of the antenna cavity 104 occupied by the antenna radiating element 108 and any other components associated with the antenna radiating element 108, such as a support structure, transmission lines and the like.

In other examples, the low-dielectric material 188 includes a combination of air, vacuum and/or open-cell foam. For example, substantially all of the interior volume of the antenna cavity structure 102, which defines the antenna cavity 104, is occupied by a combination of air and open-cell foam or a combination of vacuum and open-cell foam except for the portion of the antenna cavity 104 occupied by the antenna radiating element 108 and any other components associated with the antenna radiating element 108, such as a support structure, transmission lines and the like.

Referring still to FIGS. 1-3, in an example, the antenna cavity structure 102 includes a plurality of cavity walls, for example, including (e.g., first) cavity wall 128A, (e.g., second) cavity wall 128B, (e.g., third) cavity wall 128C, (e.g., fourth) cavity wall 128D (also referred to individually or collectively as cavity wall(s) 128) and a cavity base 130. The cavity walls 128 and the cavity base 130 define the antenna cavity 104 and the cavity walls 128 define the cavity opening 106, which is opposite the cavity base 130 (FIG. 3).

In some examples, one or more components of the antenna cavity structure 102 are integrated with one another and/or formed together. For example, the antenna cavity structure 102 may be formed (e.g., folded) from a sheet of a cavity material including, but not limited to, aluminum, copper, steel (e.g., stainless steel), conductive plastic, carbon composite, or any combination thereof. Additionally, or in the alternative, in some examples, one or more cavity walls 128 and/or the cavity base 130 may be connected together via a fastener, an adhesive, a weld, a braze, an interference fit, or any combination thereof.

In some examples, the antenna cavity structure 102 is formed from an electrically conductive material, such as metal, or carbon composite. As examples, the antenna cavity structure 102 may be formed from aluminum, copper, steel (e.g., stainless steel) or other metals. In some examples, the antenna cavity structure 102 is formed from plastic or other dielectric support structures that have been coated with metal or other conductive materials (e.g., plastic painted with conductive paint), or other suitable conductive structures including carbon composite. In some examples, one or more components of the antenna cavity structure 102 may include one or more layers of aluminum, copper, steel (e.g., stainless steel), plastic, a quartz material, a printed circuit board, a flexible printed circuit board, or any combination thereof. In some examples, the antenna cavity structure 102 may be plated. For example, one or more components of the antenna cavity structure 102 may be plated with a thin metal coating such as nickel or tin. In some examples, the antenna cavity structure 102 has an electrically conductive inner face (e.g., inner surfaces of the cavity walls 128 and cavity base 130).

In some embodiments, the antenna cavity structure 102 shields the antenna radiating element 108 from external electromagnetic interference (e.g., helps to prevent radio-frequency interference between the antenna radiating element 108 and surrounding electrical components and/or the environment). In an example, the antenna cavity structure 102 has one or more layers of different materials to shield the antenna radiating element 108 from high frequency and/or low frequency electromagnetic interference.

The antenna cavity structure 102 may have any suitable shape. In the example illustrated in FIGS. 1-3, the antenna cavity structure 102 has a rectangular (e.g., square) shape in plan view and elevation view and a rectangular shape in cross-section. In other examples, the antenna cavity structure 102 may have any other suitable shape in plan view, elevation view and/or cross-section, for example, depending upon a particular application of the antenna 100, the type of antenna radiating element 108 and other factors. Similarly, while the illustrative examples show the cavity opening 106 as having a rectangular (e.g., square) shape in plan view, in other examples, the cavity opening 106 may have any other suitable shape in plan view, for example, depending upon a particular application of the antenna 100, the type of antenna radiating element 108 and other factors.

Additionally, in some examples, the geometry of the antenna cavity structure 102 may be configured to be resonant with the electromagnetic radiation 112 (e.g., radio signals) in order to affect the gain of the electromagnetic radiation 112 and/or to affect the directionality of the electromagnetic radiation 112 emitted by the antenna radiating element 108. For example, and as illustrated in FIG. 2, the antenna cavity structure 102 has a length dimension, referred to herein as length 114, a width dimension, referred to herein as width 116, and a thickness dimension, referred to herein as thickness 118, which may be designed to be resonant for a desired frequency range (e.g., about a target frequency) of the electromagnetic radiation 112 utilized by the antenna radiating element 108, thereby increasing the efficiency of the antenna 100. Moreover, in some examples, the geometry of the cavity opening 106 may be designed to be resonant with the electromagnetic radiation 112 emitted by the antenna radiating element 108.

In the examples illustrated in FIGS. 1 and 2, the cavity opening 106 has a two-dimensional geometry (e.g., shape and dimensions) in plan view that is substantially the same as the two-dimensional geometry in plan view of the antenna cavity structure 102. In other examples, the geometry of the cavity opening 106 may be different than the geometry of the antenna cavity structure 102.

As illustrated in FIG. 3, the antenna cavity 104 formed by the antenna cavity structure 102 may be characterized by the depth 120. The depth 120 of the antenna cavity 104 is the distance the antenna cavity 104 extends below the antenna radiating element 108 (i.e., the distance between the antenna radiating element 108 and the cavity base 130). In the illustrative examples, the antenna cavity 104 has a single depth. In other examples, the antenna cavity 104 may have multiple depths.

As illustrated in FIGS. 2 and 3, the antenna radiating element 108 is mounted in the cavity opening 106 of the antenna cavity structure 102. In FIGS. 2 and 3, the antenna cavity structure 102 is oriented so that the cavity opening 106 faces upward. In an example, the antenna radiating element 108 and the cavity opening 106 substantially occupy the same plane. In other examples, the antenna radiating element 108 may lie in a first plane, which is spaced away from a second plane formed by the cavity opening 106 and located within the antenna cavity 104.

In some examples, the antenna radiating element 108 is connected to or is otherwise supported by the radome structure 110. For example, the antenna radiating element 108 may be connected to an underside or interior surface of the radome structure 110, for example, using an adhesive, mounting hardware (e.g., brackets, fasteners, etc.) or a combination thereof. In some examples, the antenna radiating element 108 is connected to or is otherwise support by the antenna cavity structure 102. In an example, the antenna radiating element 108 may be connected to one or more cavity walls 128 of the antenna cavity structure 102, for example, using an adhesive, mounting hardware (e.g., brackets, fasteners, etc.) or a combination thereof. In another example, the antenna radiating element 108 is connected one end of an antenna support structure 138 (FIG. 2). An opposing end of the antenna support structure 138 is connected to an inner face of the antenna cavity structure 102 (e.g., to the cavity wall 128 or the cavity base 130). In an example, the antenna support structure 138 is formed from a small block of very lightweight open-cell foam that has a relative permittivity (dielectric constant) approximately equal to one (1), which is substantially equivalent to that of air. In some examples, the antenna radiating element 108 is supported by the low-dielectric material 188 that fills the antenna cavity structure 102.

In various examples, the antenna radiating element 108 is one of various types of antenna radiating elements (e.g., conductors) that is electrically coupled to a transmitter and/or a receiver to operate at any suitable frequencies. In an example, the antenna radiating element 108 is a single band antenna that covers a particular desired frequency band. In an example, the antenna radiating element 108 is a multi-band antenna that covers multiple frequency bands. Different types of antennas may be used for different bands and combinations of bands. Examples of the antenna radiating element 108 include, but are not limited to, wire antennas (e.g., a monopole antenna, a dipole antenna, loop antenna, etc.), travelling wave antennas (e.g., a spiral antenna), log-periodic antennas (e.g., a bow tie antenna), aperture antennas (e.g., a slot antenna), microstrip antennas, fractal antennas, antenna arrays and the like or combinations thereof.

In some examples, the antenna cavity structure 102 and the radome structure 110 fully enclose the antenna radiating element 108. In some examples, the radome structure 110 is connected to the antenna cavity structure 102 with the antenna window 122 located over (e.g., aligned with) the antenna radiating element 108. In some examples, the antenna cavity structure 102 includes a planar lip (e.g., lip 136) (FIG. 3) that extends around a periphery of the antenna cavity structure 102. In the illustrative example, the lip 136 extends outward from the cavity walls 128 proximate to or adjacent to the cavity opening 106. In other examples, the lip 136 may extend inward from the cavity walls 128 and define the cavity opening 106. In an example, the radome structure 110 (e.g., an underside or interior surface of the radome structure 110) is connected to the lip 136, for example, using an adhesive (e.g., a conductive adhesive), fasteners or a combination thereof.

The radome structure 110 may have any suitable shape. In the examples illustrated in FIGS. 1 and 2, the radome structure 110 has a rectangular (e.g., square) shape in plan view. In other examples, the radome structure 110 may have any other suitable shape in plan view. In some examples, the radome structure 110 is flat. In some examples, the radome structure 110 has a curve in one or both lateral dimensions. The examples illustrated in FIGS. 1 and 2 show the radome structure as having a two-dimensional geometry (e.g., shape and dimensions) in plan view that is substantially the same as the two-dimensional geometry in plan view of the antenna cavity structure 102 and/or the cavity opening 106. In other examples, the geometry of the cavity opening 106 may be different than the geometry of the antenna cavity structure 102 and/or the geometry of the cavity opening 106. In an example, and as illustrated in FIG. 3, the radome structure 110 may have a lateral dimension significantly greater than one or both of the length 114 and/or the width 116 (FIG. 2) of the antenna cavity structure 102.

Figure 4:
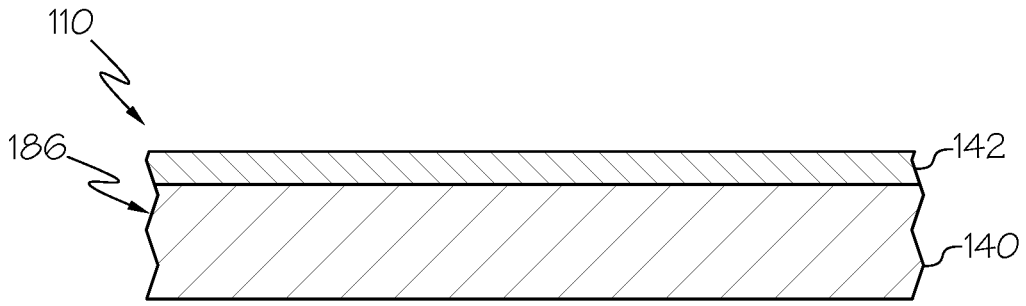
FIG. 4 is a schematic, elevation, partial, sectional view of an example of a radome structure of the disclosed antenna.

Referring to FIG. 4, in various examples, the radome structure 110 is a sandwich structure formed of a plurality of material layers. One or more of the material layers forming the radome structure 110 include the dielectric material 186. In an example of the radome structure 110 includes a foam core 140 (e.g., a foam core layer) and a current diverter 142 (e.g., a current diverter layer) connected to one side (e.g., one major surface) of the foam core 140. In some examples, the current diverter 142 is connected to one surface of the foam core 140 to form an exterior, or outward facing, surface of the radome structure 110 (i.e., the surface facing away from the antenna cavity 104). In other examples, a second current diverter 142 (not shown in FIG. 4) is connected to an opposing surface of the foam core 140 to form an interior, or inward facing, surface of the radome structure 110 (i.e., the surface facing the antenna cavity 104).

In an example, the foam core 140 is (e.g., is formed from) syntactic foam. In an example, the foam core 140 includes a polymer or ceramic matrix filled with microspheres (e.g., hollow or non-hollow microspheres). In an example, the microspheres are formed of carbon, glass, other conductive materials or combinations thereof. In an example, the foam core 140 includes the polymer or ceramic matrix filled with particles. In an example, the particles are formed from granulated carbon or other conductive material. The presence of the microspheres or particles results in dielectric loading (e.g., a higher dielectric constant or higher relative permittivity) of the foam core 140 making the foam core 140 transparent to the electromagnetic radiation 112 emitted by the antenna radiating element 108 (FIG. 3). The presence of the microspheres or particles also results in lower relative density, higher specific strength (i.e., strength divided by density) and lower coefficient of thermal expansion. After the filled matrix has set, the fully formed foam core 140 may be machined to have any shape, for example, according to the application of the radome structure 110

The current diverter 142 is configured to protect the antenna 100 from the effects of a lightning strike and/or a static charge build-up with a negligible effect on the pattern characteristics of the electromagnetic radiation 112 passing through the radome structure 110. In an example, the current diverter 142 may include one or more current diversion strips connected (e.g., adhered) to the surface of the foam core 140. In an example, the current diverter 142 is a metal applique that is applied to the surface of the foam core 140.

Figure 5:
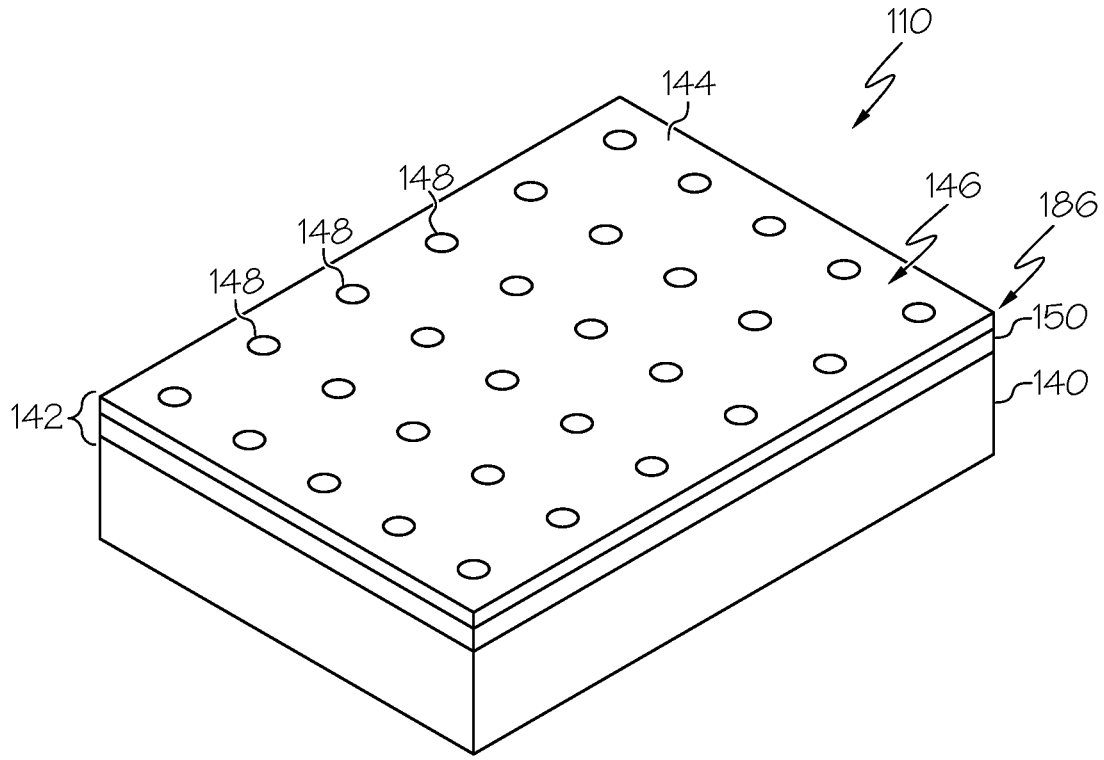
FIG. 5 is a schematic, perspective view of an example of the radome structure of the disclosed antenna.

Referring to FIG. 5, in an example, the current diverter 142 is a sheet of metaling foil having etched elements, referred to herein as etched foil 144 (e.g., an etched foil layer) connected (e.g., adhered) to the surface of the foam core 140. The etched foil 144 serves as a current diverting surface that is transparent to the electromagnetic radiation 112. For example, the etched foil 144 is a sheet of copper foil that has a bandpass pattern 146 etched into, or through, the copper foil. The pattern 146 includes a plurality of etched elements 148, for example, holes or apertures formed in or through the sheet of foil. The pattern 146 of the etching and the geometry of the etched elements 148 are designed to enable the electromagnetic radiation 112 (e.g., at least at the operating frequency of the antenna radiating element 108) to pass through the etched foil 144 unaffected. Examples of the two-dimensional geometry of the etching (e.g., a perimeter shape of each etched element 148) in the copper foil include, but are not limited to, a rectangular shape, a square shape, a circular shape, a triangular shape, an elliptical shape, an annular shape, a plus sign shape, an ogive shape (e.g., having at least one roundly tapered end), a cross shape, a chicken-foot shape, an "X" shape, a polygonal shape (e.g., a hexagon, octagon, etc.), other shapes and combinations thereof.

In some examples, the current diverter 142 (e.g., the etched foil 144) is, or serves as, a frequency-selective surface (FSS) designed to reflect, transmit or absorb electromagnetic fields based on the frequency of the field. In some examples, the current diverter 142 enables at least a portion of the radome structure 110, for example, the antenna window 122, to be electromagnetically transparent to electromagnetic radiation at one or more select or predefined frequencies (e.g., frequency bands) or wavelengths (e.g., first electromagnetic radiation) and to be electromagnetically opaque to electromagnetic radiation at one or more other select or predefined frequencies or wavelengths (e.g., second electromagnetic radiation). In some other examples, in addition to or in place of the current diverter 142, one or more of the material layers forming the radome structure 110 define or serve as the frequency-selective surface (e.g., enables the frequency-selective functionality of the radome structure 110).

In some examples, the current diverter 142 also includes an insulator 150 (e.g., an insulator layer). In an example, the etched foil 144 is connected (e.g., adhered) to a surface of the insulator 150 and the insulator 150 is connected (e.g., adhered) to the surface of the foam core 140. In an example, the insulator 150 is a sheet or panel of polyetheretherketone (PEEK).

Figure 6:
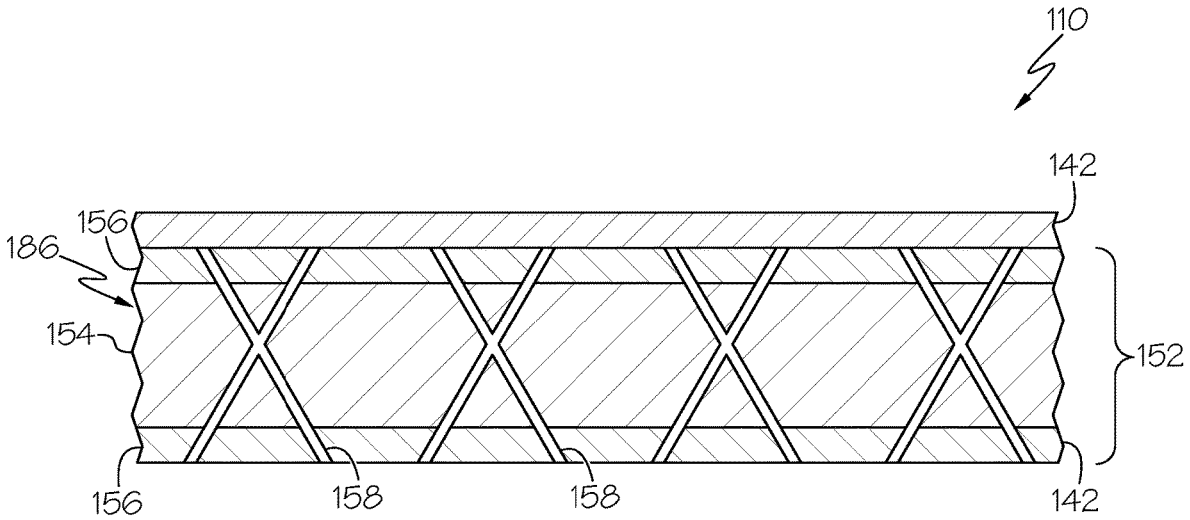
FIG. 6 is a schematic, elevation, partial, sectional view of an example of the radome structure of the disclosed antenna.

Referring to FIG. 6, an example of the radome structure 110 includes a laminate core 152 (e.g., a laminate core layer) and the current diverter 142 (e.g., the current diverter layer) connected to one side of the laminate core 152. In some examples, the current diverter 142 is connected to one surface of the laminate core 152 to form an exterior, or outward facing, surface of the radome structure 110 (i.e., the surface facing away from the antenna cavity 104). In other examples, a second current diverter 142 (not shown in FIG. 6) is connected to an opposing surface of the laminate core 152 to form an interior, or inward facing, surface of the radome structure 110 (i.e., the surface facing the antenna cavity 104).

In an example, the laminate core 152 includes a foam core 154 (e.g., a foam core layer), a first face sheet 156 (e.g., a first face sheet layer) connected to one surface of the foam core 154 and a second face sheet 156 (e.g., a second face sheet layer) connected to an opposing surface of the foam core 154. In some examples, the laminate core 152 includes reinforcing pins (pins 158) extending through at least the foam core 154. In some examples, the pins 158 extend into one or both of the face sheets 156.

In an example, the foam core 154 is (e.g., is formed from) open cell foam. In an example, the foam core 154 is ROHACELL® foam that is commercially available from Evonik Röhm GmbH of Darmstadt, Germany.

In some examples, the pins 158 are stitched or pultruded through the foam core 154, in which the foam core 154 may also referred to as pin-pultruded foam. The pins 158 reinforce the structural and load-bearing characteristics of the foam core 154 and, thus, the radome structure 110. The presence of the pins 158 may also provide a highly durable and ballistic resistant radome structure 110. In some examples, the pins 158 are made of a conductive material (i.e., conductive pins) including, but not limited to, carbon, carbon graphite or other conductive materials. The presence of the pins 158 results in dielectric loading (e.g., a higher dielectric constant or relative permittivity) of the foam core 154 making the foam core 154 transparent to the electromagnetic radiation 112 emitted by the antenna radiating element 108 (FIG. 3).

In an example, the pin-pultruded foam core of the radome structure 110 (i.e., the foam core 154 and the pins 158) is X-COR® that is commercially available from Albany Engineered Composites, Inc. of New Hampshire, USA.

The geometry of the pins 158, the density per volume of the pins 158, the shape of the pins 158, the size of the pins 158, the number of pins 158, and/or the orientation of the pins 158 relative to the foam core 154 may be tailored based, for example, on the frequency band of the antenna radiating element 108, the structural characteristics desired for the radome structure 110 and other factors. In some examples, tailoring the characteristics of the pins 158 enables an increase in the relative permittivity of the radome structure 110, which provides an additional increase in the potential depth reduction achieved using the radome structure 110.

In an example, the face sheets 156 include (e.g., are formed from) one or more sheets, or plies, of a fiber-reinforced polymer. In an example, the face sheets 156 include (e.g., are formed from) one or more sheets, or plies, of resin-infused (e.g., pre-impregnated), woven carbon graphite fiber cloth. In an example, the face sheets 156 include (e.g., are formed from) one or more sheets, or plies, of resin-infused (e.g., pre-impregnated), woven glass fiber (fiberglass) cloth. In an example, the face sheets 156 include (e.g., are formed from) one or more sheets, or plies, of resin-infused (e.g., pre-impregnated), woven quartz fiber cloth. In an example, the face sheets 156 include (e.g., are formed from) one or more sheets, or plies, of woven fiber-reinforced (e.g., glass fiber, quartz fiber, carbon fiber, etc.) cloth infused (e.g., pre-impregnated) with a cyanate ester epoxy resin. In an example, the face sheets 156 include (e.g., are formed from) one or more sheets, or plies, of ASTROQUARTZ® that is commercially available from JPS Composite Materials Corp. of Delaware, USA.

Figure 7:
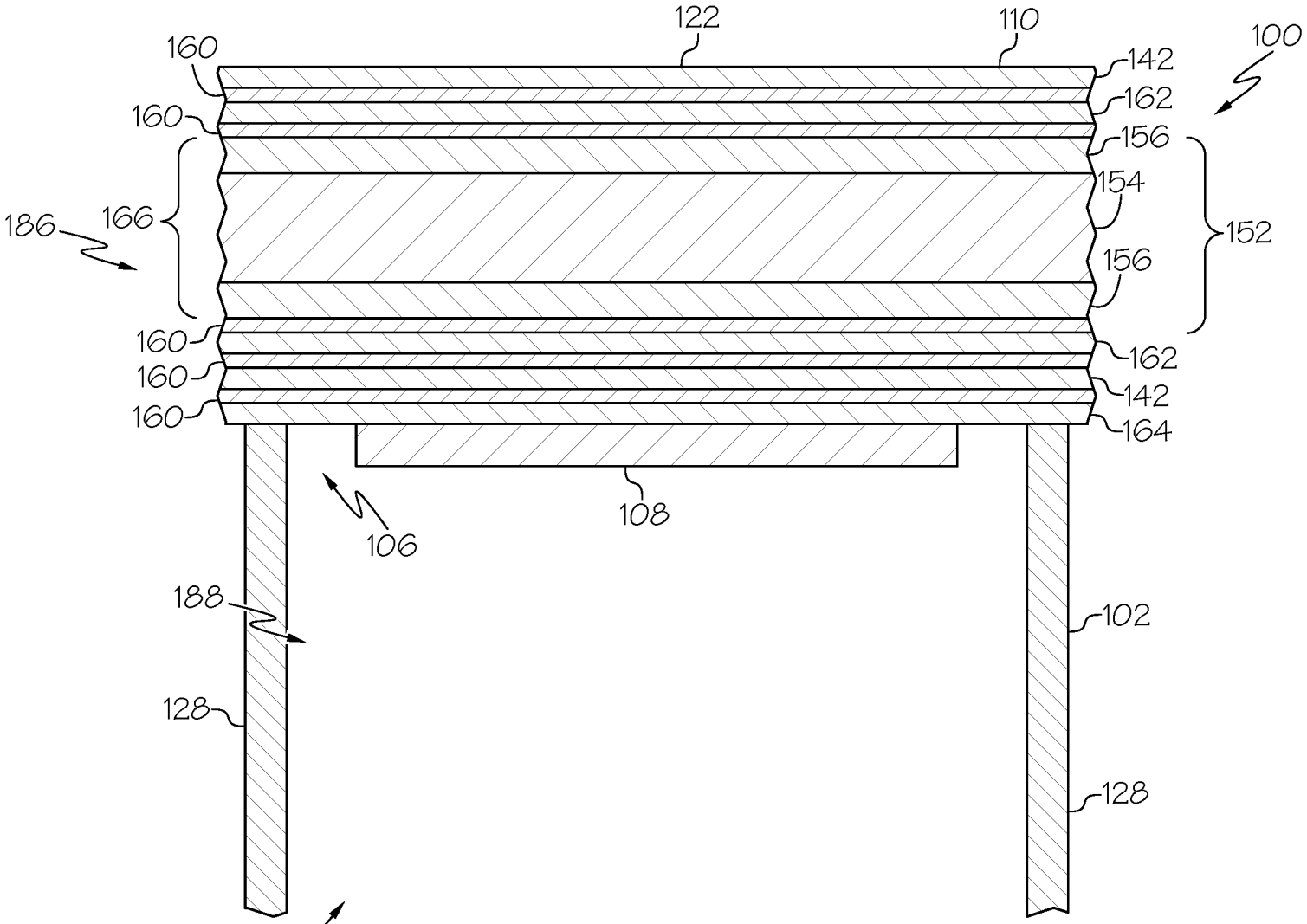
FIG. 7 is a schematic, elevation, partial, sectional view of an example of the radome structure of the disclosed antenna.

Referring to FIG. 7, another example of the radome structure 110 includes a core 166 (e.g., a core layer). In an example, and as illustrated in FIG. 7, the core 166 includes the laminate core 152 (e.g., the laminate core layer). Alternatively, in another example (not shown), the core 166 is the foam core 140 (e.g., the foam core layer) (FIG. 4).

In some examples, the radome structure 110 includes a first reinforcement 162 (e.g., a first reinforcement layer) connected to one surface of the core 166. In some examples, the radome structure 110 includes a second reinforcement 162 (e.g., a second reinforcement layer) connected to the opposing surface of the core 166. In some examples, the reinforcement 162 is adhered to the core 166 by a pressure sensitive adhesive 160 (e.g., an adhesive layer). The presence of the reinforcement 162 increases the structural characteristics of the radome structure 110.

In an example, the reinforcement 162 includes (e.g., is formed from) one or more sheets, or plies, of a fiber-reinforced polymer. In an example, the reinforcement 162 includes (e.g., is formed from) one or more sheets, or plies, of resin-infused (e.g., pre-impregnated), woven glass fiber (fiberglass) cloth. In an example, the face sheets 156 include (e.g., are formed from) one or more sheets, or plies, of resin-infused (e.g., pre-impregnated), woven quartz fiber cloth. In an example, the face sheets 156 include (e.g., are formed from) one or more sheets, or plies, of resin-infused (e.g., pre-impregnated), woven quartz fiber cloth. In an example, the face sheets 156 include (e.g., are formed from) one or more sheets, or plies, of woven fiber-reinforced (e.g., glass fiber, quartz fiber, carbon fiber, etc.) cloth infused (e.g., pre-impregnated) with a cyanate ester epoxy resin. A thickness dimension of the reinforcement 162 may vary depending, for example, of the application of the antenna 100, the structural or load-bearing requirements of the radome structure 110 and other factors.

In some examples, the radome structure 110 includes a first current diverter 142 (e.g., a first current diverter layer) connected to the first reinforcement 162. In the illustrative example, the first current diverter 142 forms the exterior face of the radome structure 110 (e.g., an outer current diverter). In some examples, the radome structure 110 includes a second current diverter 142 (e.g., a second current diverter layer) connected to the second reinforcement 162. In the illustrative example, the second current diverter 142 may form the interior face of the radome structure 110 (e.g., an inner current diverter). In some examples, the current diverter 142 is adhered to the reinforcement by the pressure sensitive adhesive 160 (e.g., the adhesive layer).

In some examples, the antenna radiating element 108 is spaced away from the radome structure 110 and, particularly, spaced away from the inner current diverter 142 by a spacer 164 (e.g., a spacer layer). In an example, the spacer 164 is air. In an example, the spacer 164 is an electromagnetically transparent film or foam, such as a syntactic film or a syntactic foam that is connected, for example, by the pressure sensitive adhesive 160, to the inner current diverter 142. The presence of the spacer 164 reduces the probability that an electrical arc will jump from the radome structure 110 (e.g., the current diverter 142) to the antenna radiating element 108 in response to a lightning strike or a static charge. A thickness dimension of the spacer 164 may be tailored to maximize the reduction of a potential electrical arc.

Other configurations of the layers forming the sandwich structure of the radome structure 110 are also contemplated. In an example, one of the current diverters 142, for example, the inner current diverter, may be removed from the stack. In an example, one or more of the reinforcements 162 may be removed from the stack. In an example, one or more additional reinforcements 162 may be added to the stack.

Figure 8:
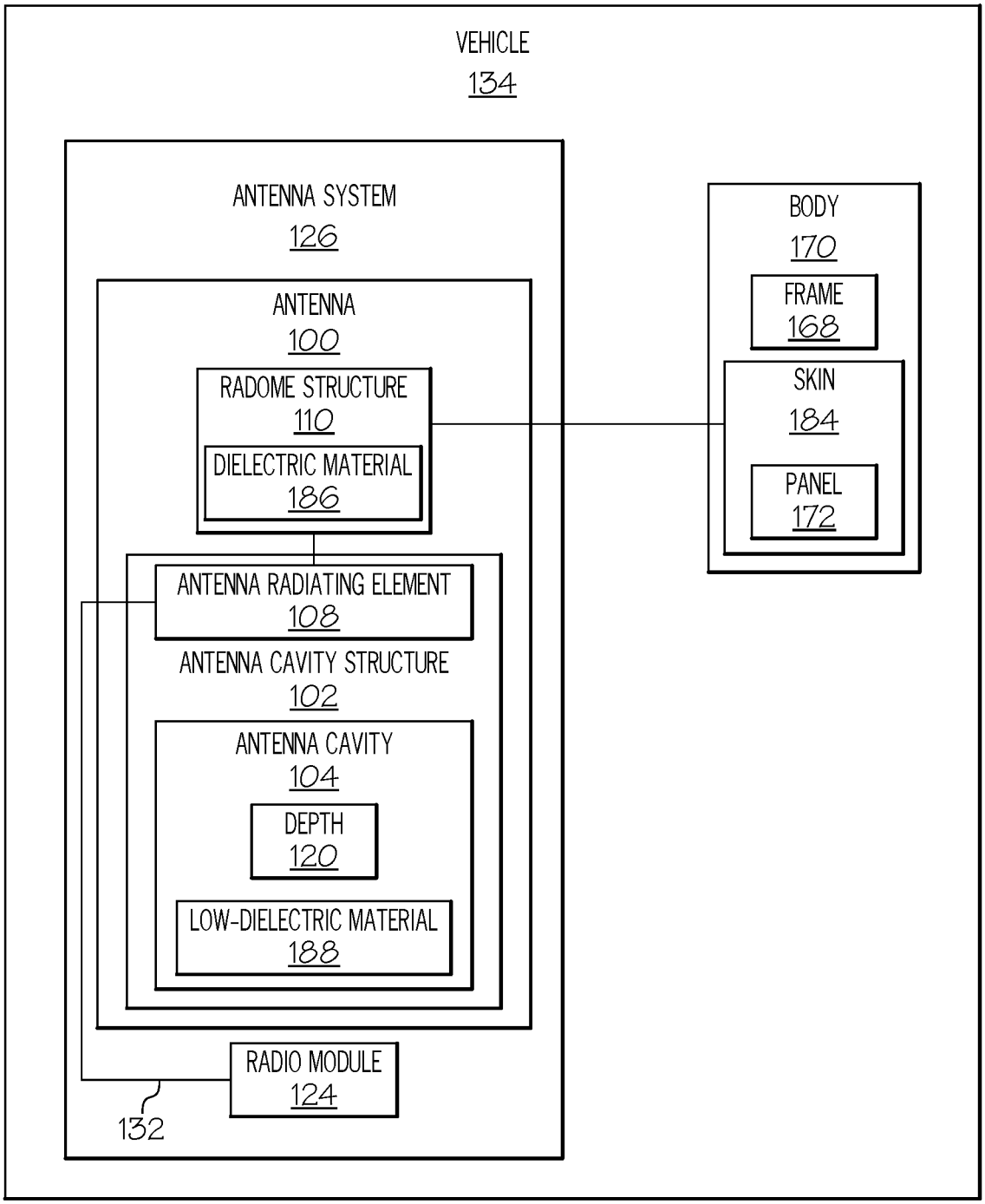
FIG. 8 is a block diagram illustrating an example of a disclosed antenna system.

Referring to FIG. 8, in an example, the disclosed antenna 100 is a component of a disclosed antenna system 126. In an example, the disclosed antenna system 126 includes a radio module 124. The radio module 124 is operatively coupled to the antenna radiating element 108, for example, via transmission lines 132. The transmission lines 132 convey radio-frequency signals between the radio module 124 and the antenna radiating element 108. The transmission lines 132 may include any suitable conductive pathways over which radio-frequency signals may be conveyed including transmission line path structures such as coaxial cables, microstrip transmission lines, printed circuit board (PCB) line traces, etc. For example, a coaxial cable ground conductor may be coupled to the antenna cavity structure 102 and may be coupled to an antenna feed terminal (e.g., a ground feed) within the antenna cavity structure 102. A coaxial cable signal conductor may be coupled to another antenna feed terminal (e.g., a positive feed) that is associated with the antenna radiating element 108 in the antenna cavity structure 102.

In some examples, the radio module 124 is remotely located relative to the antenna radiating element 108 and is mounted on a suitable mounting structure. In an example, the radio module 124 is located outside of the antenna cavity structure 102. For example, the radio module 124 may be located in an operator's compartment of a vehicle 134 (e.g., a cab, cockpit, etc.). In some examples, the radio module 124 is co-located with the antenna radiating element 108. In an example, the radio module 124 is located at least partially within the antenna cavity structure 102 with the antenna radiating element 108. In some examples, the antenna radiating element 108 is separate from the radio module 124. In some examples, the antenna radiating element 108 is integrally formed with the radio module 124. For example, where the radio module 124 is disposed on a printed circuit board, the antenna radiating element 108 may be a printed element of the printed circuit board. In some examples, the antenna radiating element 108 is integrated with the radio module 124.

In an example, the radio module 124 includes, but is not limited to, processing circuitry (e.g., wireless transmitter) configured to transmit information via one or more radio signals in a desired frequency band or spectrum (e.g., 100 MHz to 20 GHz, 300 MHz to 10 GHz, 800 MHz to 5 GHz, 1 GHz to 2.5 GHz, etc.), processing circuitry (e.g., wireless receiver) configured to receive information via one or more radio signals in a desired frequency band or spectrum, or any combination thereof (e.g., wireless transceiver).

The antenna radiating element 108 is electromagnetically coupled with the radome structure 110 to enable the electromagnetic radiation 112 (FIG. 3) emitted by the antenna radiating element 108 to pass through the radome structure 110, for example, without affecting the transmission or wave characteristics of the electromagnetic radiation 112. For example, the antenna radiating element 108 and the radome structure 110 have mutual (e.g., matching) inductance and mutual (e.g., matching) capacitance. Similarly, the antenna radiating element 108 is electromagnetically coupled with the antenna cavity structure 102 to tune the frequency of the electromagnetic radiation 112 emitted by the antenna radiating element 108 and enable directional control of the electromagnetic radiation 112. For example, the antenna radiating element 108 and the antenna cavity structure 102 have mutual (e.g., matching) inductance and mutual (e.g., matching) capacitance.

In some examples, the disclosed antenna system 126 is installed on or is utilized by the disclosed vehicle 134, for example, for communication, radar or other purposes. In some examples, the antenna 100 is integrated with a body 170 of the vehicle 134. In an example, the body 170 of the vehicle 134 includes a frame 168 and a skin 184 connected to the underlying frame 168. In some examples, the skin 184 includes, or is formed of, a plurality of panels 172 that are connected to the frame 168 and, optionally, to other panels 172. In some examples, the radome structure 110 forms a part of the exterior surface of the body 170. In an example, the radome structure 110 is connected to the frame 168 and/or to one or more of the panels 172 to form a portion of the skin 184. As such, in some examples, the antenna 100 is a conformal antenna and the radome structure 110 is tailored to have a profile shape that substantially matches the outer shape of the body 170.

In an example of a conformal antenna 100, the radome structure 110 is non-structural. For example, the radome structure 110 covers the antenna radiating element 108 (e.g., protects the antenna radiating element 108 from the environment) and forms a non-load-bearing component or portion of the body 170. An example of a non-structural radome structure 110 is the radome structure 110 that includes the foam core 140 (FIG. 4). In another example of a conformal antenna 100, the radome structure 110 is structural. For example, the radome structure 110 covers the antenna radiating element 108 (e.g., protects the antenna radiating element 108 from the environment) and forms a load-bearing component or portion of the body 170. An example of a structural radome structure 110 is the radome structure 110 that includes the laminate core 152 (FIGS. 6 and 7). As used herein, the term "structural" generally refers to the ability to handle, or react to, the strains, stresses and/or forces, generally referred to herein as "loads," for example, encountered during movement of the vehicle 134. In some examples, the radome structure 110 is a primary structure of the body 170, in which the radome structure 110 is essential for carrying loads (e.g., strains, stresses and/or forces) encountered during movement of the vehicle 134 (e.g., during flight of an aerospace vehicle). In some examples, the radome structure 110 is a secondary structure of the body 170, in which the radome structure 110 assists the primary structure in carrying loads encountered during movement of the vehicle 134.

In other examples, the disclosed antenna system 126 is installed on or is utilized by an electronic device, such as a computer, a smart phone, a GPS device and the like.

Figure 9:
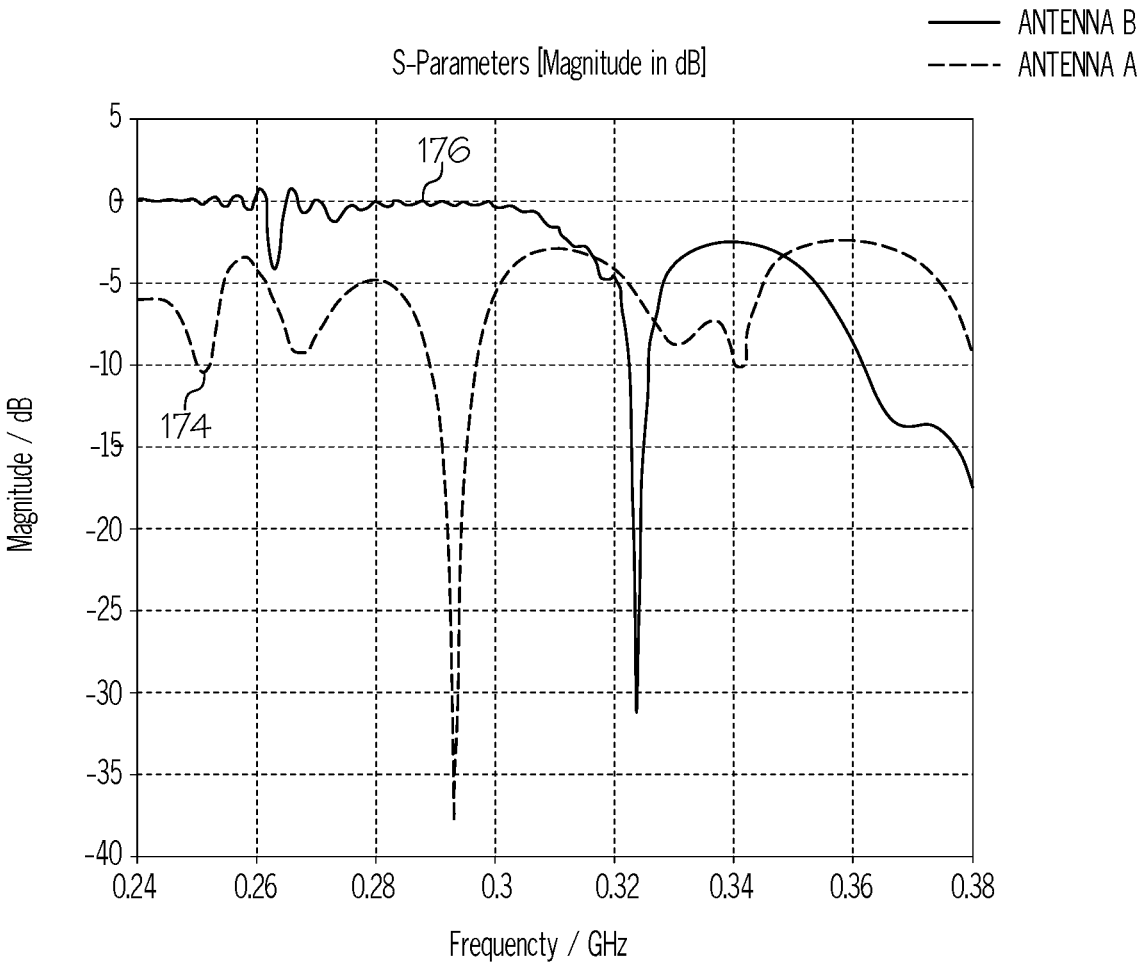
FIG. 9 is an illustration of comparative reflection loss of an example of the disclosed antenna.

FIG. 9 illustrates a plot representing reflection loss in terms of a magnitude of the reflection coefficient in decibels (dB) along the Y-axis, as a function of frequency in GHz along the X-axis. The illustrated example compares reflection loss of antenna A (shown by plot line 174) against the reflection loss of antenna B (shown by plot line 176) in a frequency band ranging from approximately 0.24 GHz to approximately 0.38 GHz. Antenna A is an example of the disclosed antenna 100. In the illustrative example, antenna A includes the antenna cavity structure 102, defining the air-filled antenna cavity 104 having the depth 120 of approximately four (4) inches, and the radome structure 110. Antenna B is an example of a traditional air-filled, cavity-backed antenna. In the illustrative example, antenna B includes an antenna cavity structure defining an air-filled cavity having a depth of approximately four (4) inches, but without the disclosed radome structure 110.

Generally, reflection loss represents the amount of energy sent from a radio to an antenna actually reaches the antenna and the amount of energy that is sent, or bounced, back (i.e., reflected) from the antenna to the radio. Generally, a lower reflection loss is desirable, which represents more energy being accepted by the antenna and not reflected back to the radio. In the illustrative plot, the negative numbers of the magnitude in dB (along the Y-axis) represent lower reflection loss. Examples of an acceptable reflection loss that enables proper function of the antenna are between approximately negative five (−5) dB and approximately negative ten (−10) dB.

As illustrated by plot line 174, antenna A has a reflection loss close to or below negative five (−5) dB in the entire frequency band and, as such, antenna A functions properly in the entire frequency band. Comparatively, and as illustrated by plot line 176, antenna B has a reflection loss close to zero (0) dB from 0.24 GHz to approximately 0.3 GHz and, as such, antenna B does not function in that range of frequencies. Thus, the presence of the radome structure 110 enables a four (4) inch deep air-filled, cavity-backed antenna to function in a significantly larger frequency band.

Figure 10:
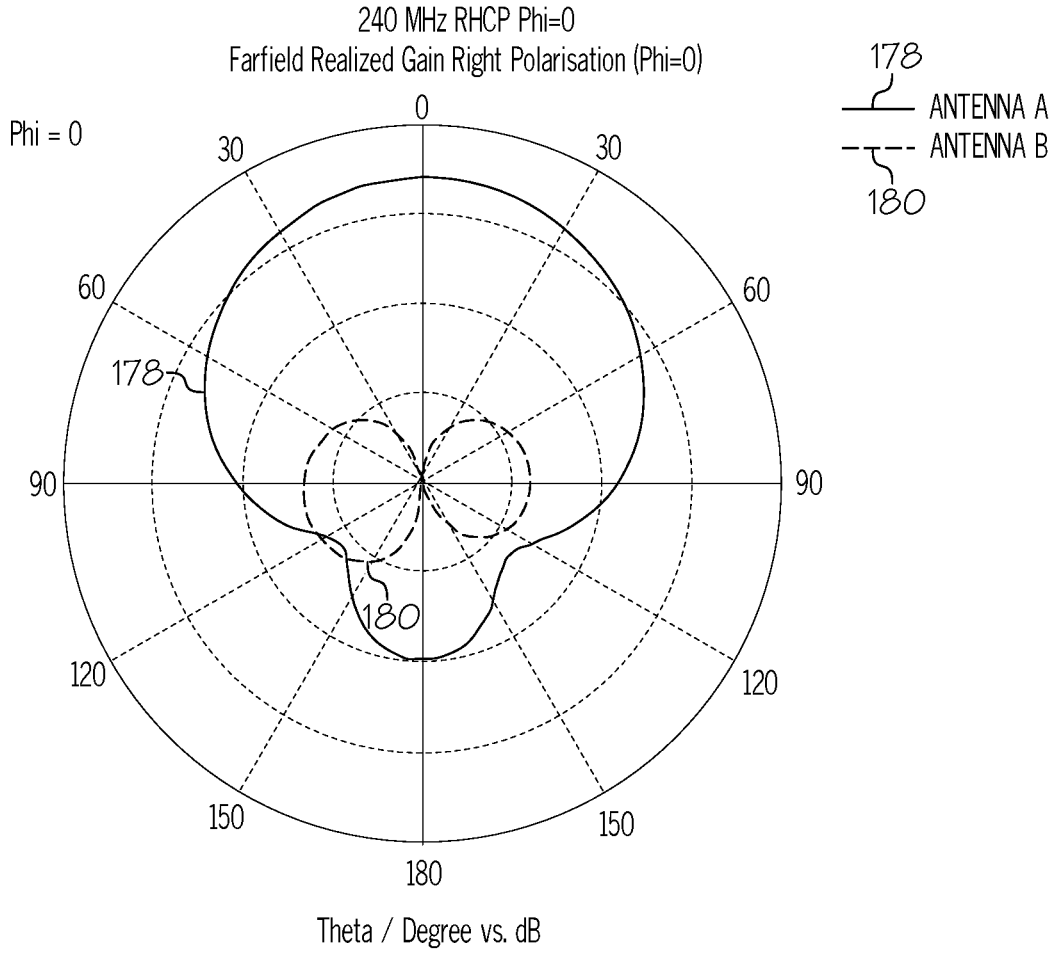
FIG. 10 is an illustration of comparative realized gain of an example of the disclosed antenna.
Figure 11:
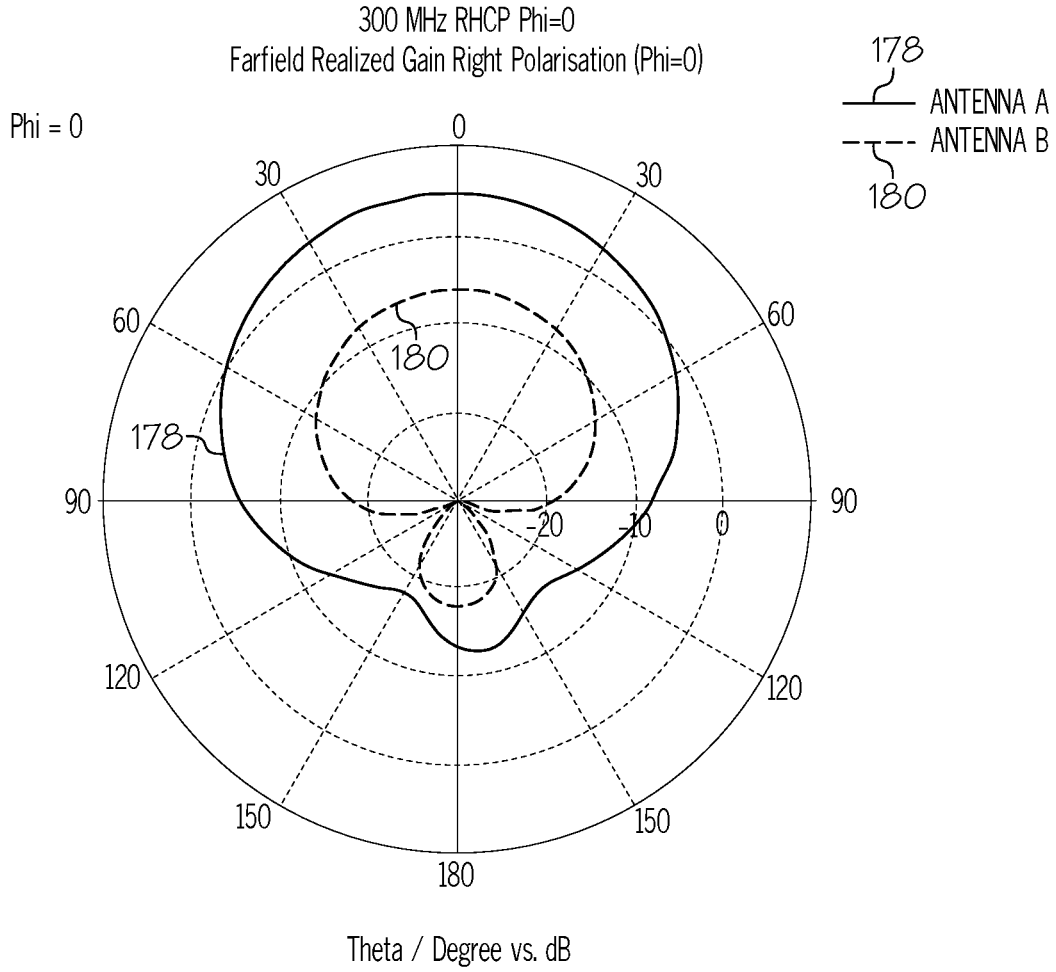
FIG. 11 is an illustration of comparative realized gain of an example of the disclosed antenna.
Figure 12:
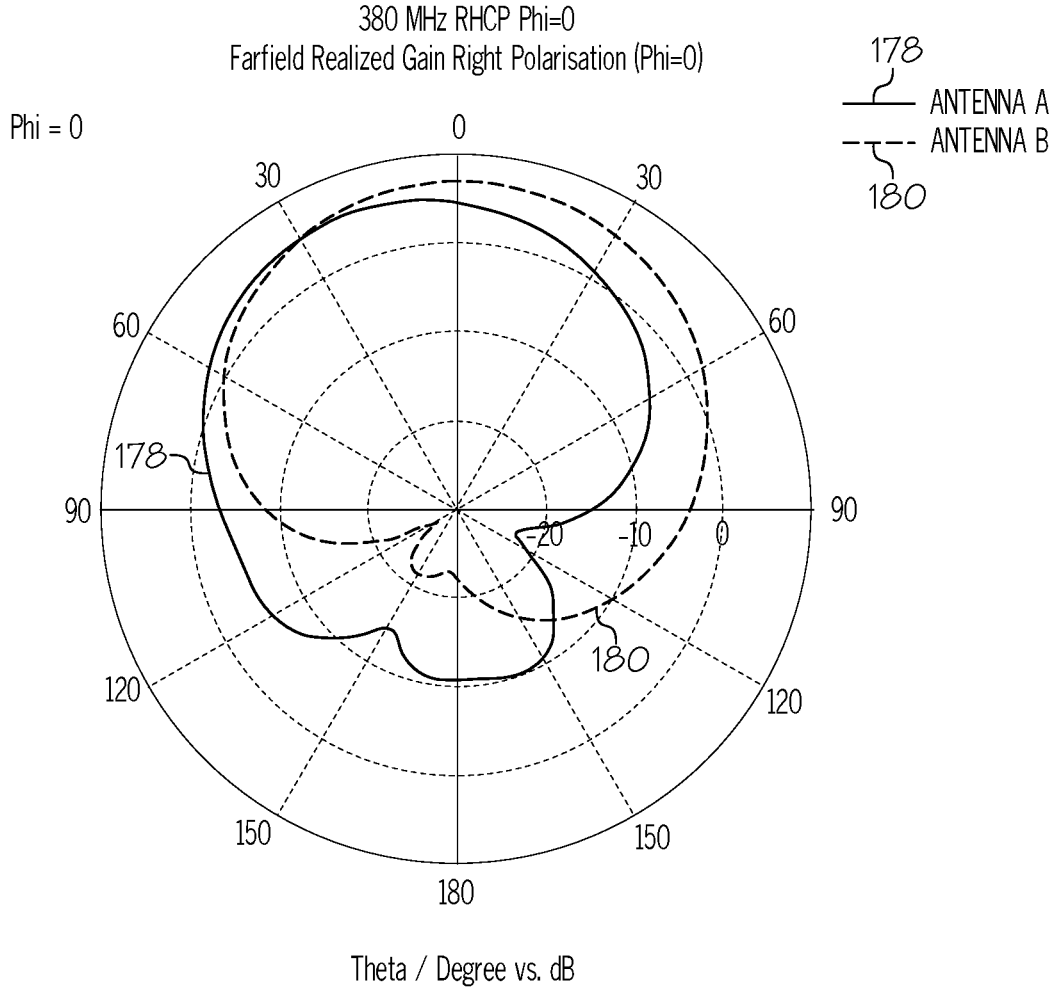
FIG. 12 is an illustration of comparative realized gain of an example of the disclosed antenna.

FIGS. 10-12 illustrate a realized gain pattern (right hand circular polarized (RHCP) elevation pattern) of antenna A (shown by radiation pattern 178) against a realized gain pattern of antenna B (shown by radiation pattern 180) at various different operating frequencies. FIG. 10 compares the radiation patterns of antenna A and antenna B operating at a frequency of 240 MHz. As illustrated in FIG. 10, the pattern shape and magnitude of antenna B is poor versus antenna A. FIG. 11 compares the radiation patterns of antenna A and antenna B operating at a frequency of 300 MHz. As illustrated in FIG. 11, the pattern shape of antenna B is poor versus antenna A. FIG. 12 compares the radiation patterns of antenna A and antenna B operating at a frequency of 380 MHz. As illustrated in FIG. 12, the pattern shape and magnitude of antenna B is comparable to antenna A.

Accordingly, examples of the antenna utilizing the dielectric radome structure disclosed herein enable air-filled antenna cavities to be designed having a cavity depth of less than one-fourth (¼) of the wavelength of the operating frequency of the antenna. The reduction in the depth of the antenna cavity beneficially results in a reduction in size needed to accommodate the antenna. Additionally, the weight of the radome structure covering the antenna cavity is beneficially low compared to cavity-filler material used to achieve a similar dielectric loading in cavities having a depth of less than one-fourth (¼) wavelength. Further, the presence of the radome structure defining an exterior surface of the antenna provides the additional benefit of lightning strike, static charge and environmental protection to the antenna. Moreover, the design of the disclosed antenna is scalable to any desired operating frequency.

Figure 13:
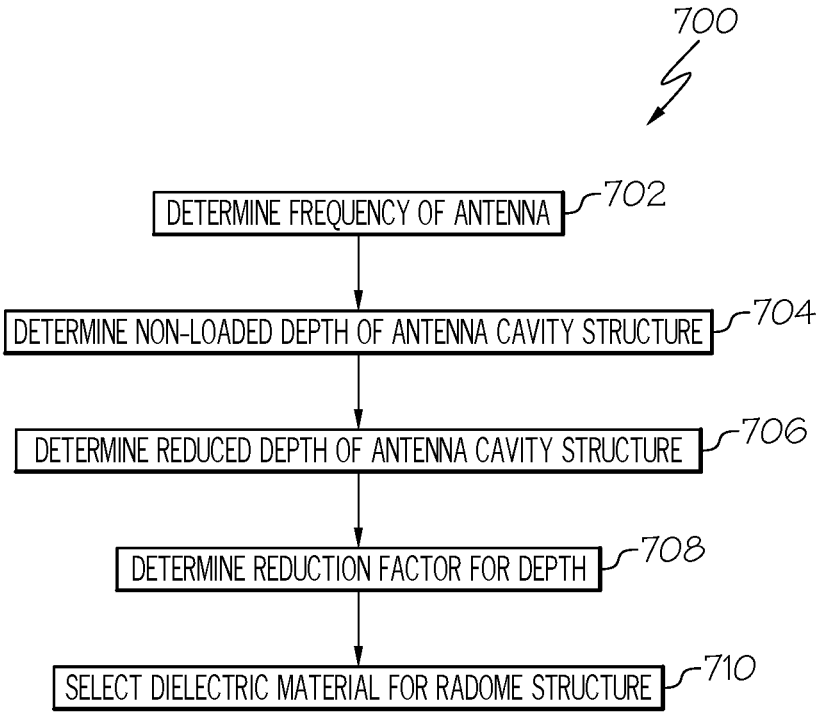
FIG. 13 is a flow diagram of an example of a disclosed method of designing an antenna system.

Referring to FIG. 13, also disclosed is an example method 700 of designing a cavity-backed antenna having a reduced cavity depth, such as the disclosed antenna 100. In an example, the method 700 includes a step of determining an operating frequency of the antenna 100, as shown at block 702. In an example, the frequency of the antenna 100 is defined by the antenna radiating element 108 that is located within the antenna cavity structure 102 of the antenna 100 and the radio module 124. The method 700 also includes a step of determining a non-loaded depth of the antenna cavity structure 102 at the operating frequency of the antenna 100, as shown at block 704. As used herein, the non-loaded depth is the depth 120 of the antenna cavity structure 102 when the antenna 100 is not dielectrically loaded, for example, when the antenna cavity structure 102 is not filled with the loading material (e.g., an air-filled cavity). Generally, the non-loaded depth of the antenna cavity structure 102 is at least (e.g., equal to or greater than) one-fourth (¼) of a wavelength of the operating frequency of the antenna 100. The method 700 also includes a step of determining a reduced depth of the antenna 100, as shown at block 706. As used herein, the reduced depth is the depth 120 of the antenna cavity structure 102 is the desired depth or the maximum allowable depth of the antenna cavity structure 102 given the particular application of the antenna 100. The method 700 also includes a step of determining a reduction factor required to achieve the reduced depth (e.g., the factor needed to reduce the non-loaded depth to the reduced depth), as shown at block 708. The reduction factor reduces the depth of the antenna cavity structure to be less than one-fourth (¼) of a wavelength of the operating frequency of the antenna 100. In some examples, the reduction factor varies and may be based on numerous factors such as the space constraints of the antenna 100. The method 700 also includes a step of selecting, or determining, the dielectric material 186 to be used to form the radome structure 110 that achieves the desired reduction factor, as shown at block 710. In some examples, selection of the dielectric material 186 is defined by, or is based on, the relative permittivity and the relative permeability of the dielectric material 186. As expressed above, the reduction factor will be equal to the inverse of the square root of the product of the relative permittivity and the relative permeability of the dielectric material 186 of the radome structure 110. In some examples, the step of determining the material configuration of the radome structure 110, including selection of the dielectric material 186, is performed by a parametric study of numerous variables.

In some examples, selection of the materials used to form the radome structure 110, including the dielectric material 186, is a function of the wavelength of the antenna 100, the polarization of the antenna 100, the desired transmission loss through the radome structure 110 as a function of wavelength, the relative size, shape, and/or orientation of the material particles (e.g., pins 158) used in the radome structure 110 relative to the impinging electromagnetic radiation 112 from the antenna 100. Balancing these design variables is typically achieved using simulations and parametric adjustment of multiple variables in a goal-oriented optimization study.

Figure 14:
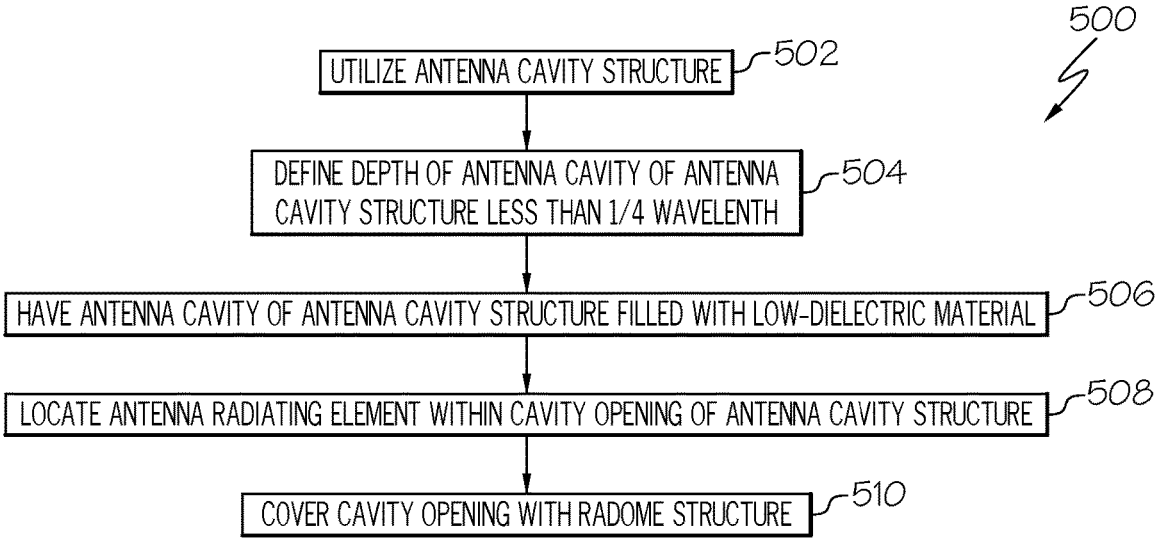
FIG. 14 is a flow diagram of an example of a disclosed method of manufacturing the disclosed antenna.

Referring to FIG. 14, also disclosed is an example method 500 of manufacturing the disclosed antenna 100. In an example, the method 500 includes a step of utilizing the antenna cavity structure 102, as shown at block 502. The antenna cavity structure 102 defines the antenna cavity 104 and has the cavity opening 106. In some examples, the antenna cavity structure 102 is formed or otherwise provided in accordance with FIGS. 1-3 and 7. The method 500 also includes the step of defining the depth 120 of the antenna cavity to be less than one-fourth (¼) of a wavelength of the operating frequency of the antenna radiating element 108 utilized with the antenna 100, as shown at block 504. In some examples, the depth 120 of the antenna cavity structure 102 is defined by the desired reduced depth achieved by the reduction factor, as illustrated by method 700 (FIG. 13). The method 500 also includes a step of having the antenna cavity 104 filled with the low-dielectric material 188, as shown at block 506. The method 500 also includes a step of locating the antenna radiating element 108 within the cavity opening 106 of the antenna cavity structure 102, as shown at block 508. The method 500 also includes a step of covering the cavity opening 106 with the radome structure 110 so that the antenna radiating element 108 is located between the radome structure 110 and the antenna cavity 104 and the antenna window 122 is aligned with antenna radiating element 108, as shown at block 510. In some examples, the dielectric material 186 of the radome structure 110 is selected in accordance with method 700 (FIG. 13) and the radome structure 110 is formed or otherwise provided in accordance with FIGS. 1-7.

Figure 15:
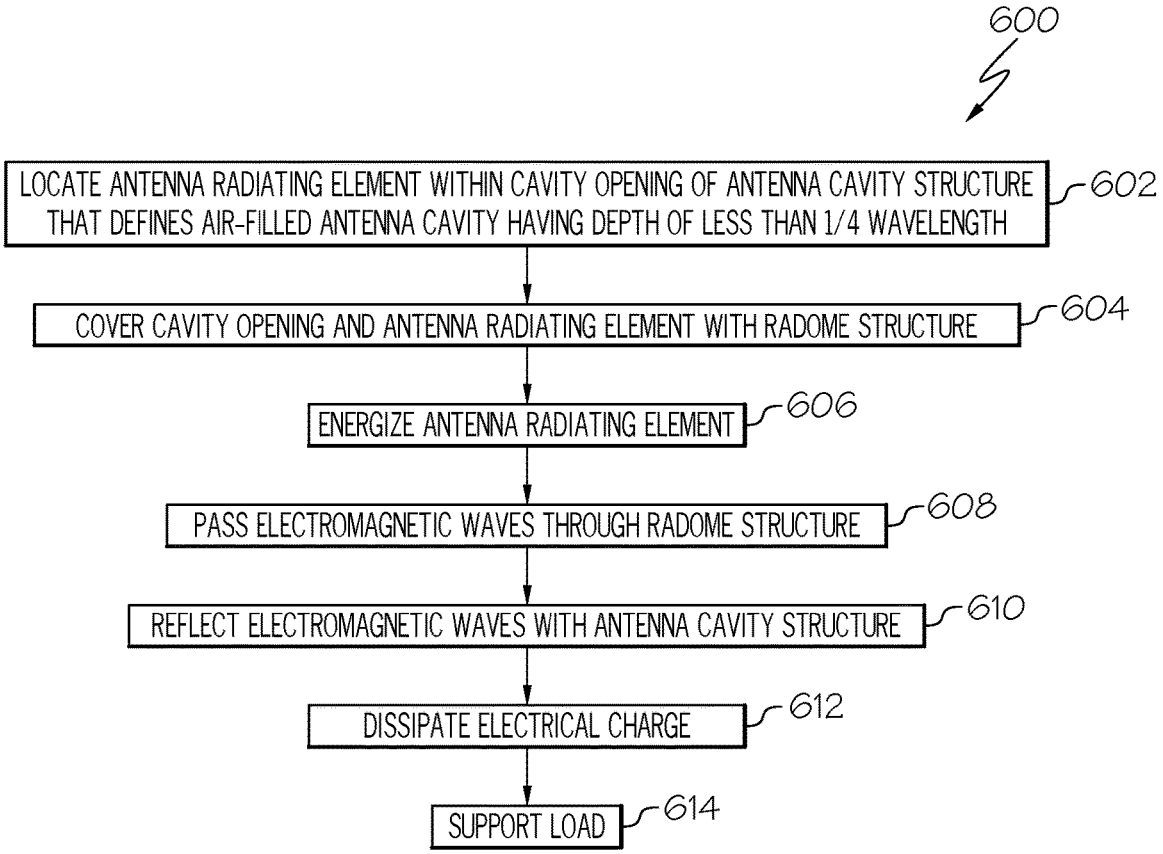
FIG. 15 is a flow diagram of an example of a disclosed method of controlling a direction of electromagnetic waves in an antenna system.

Referring to FIG. 15, also disclosed is an example method 600 of controlling a radiation pattern and magnitude of electromagnetic (e.g., radio) waves in an antenna system. The disclosed method 600 utilizes examples of the antenna system 126 and the antenna 100 disclosed herein. In an example, the method 600 includes a step of locating the antenna radiating element 108 within the cavity opening 106 of the antenna cavity structure 102 that defines the antenna cavity 104 having the depth 120 less than one-fourth (¼) of a wavelength of the operating frequency of the antenna radiating element 108 utilized with the antenna 100, as shown at block 602. The method 600 also includes a step of covering the cavity opening 106 and the antenna radiating element 108 with the radome structure 110, as shown at block 604. The dielectric material 186 of the radome structure 110, forming at least the antenna window 122 of the radome structure 110, is configured (e.g., tailored or tuned) to enable the electromagnetic waves (e.g., electromagnetic radiation 112) to pass through the radome structure 110 without affecting the characteristics of the electromagnetic waves. The method 600 includes a step of energizing the antenna radiating element 108 with the radio module 124 to emit the electromagnetic waves, as shown at block 606. The method 600 also includes a step of passing the electromagnetic waves through the radome structure 110, as shown at block 608. The method 600 also includes a step of reflecting the electromagnetic waves using the antenna cavity structure 102 such that the electromagnetic waves are directed through the cavity opening 106, as shown at block 610. The method 600 also includes a step of dissipating an electrical charge using the current diverter 142 of the radome structure 110, for example, in response to a lightning strike or a static charge build-up, as shown at block 612. In some examples, the current diverter 142 is electrically coupled to a ground, such as the body 170 of the vehicle 134. In response to a lightning strike or a static charge, the current diverter 142 dissipates the electrical charge and passes the current over the radome structure 110 to prevent the electrical charge from damaging the antenna radiating element 108 or the radio module 124. The method 600 also includes a step of supporting, or reacting to, a load applied to the radome structure 110, as shown at block 614.

Figure 16:
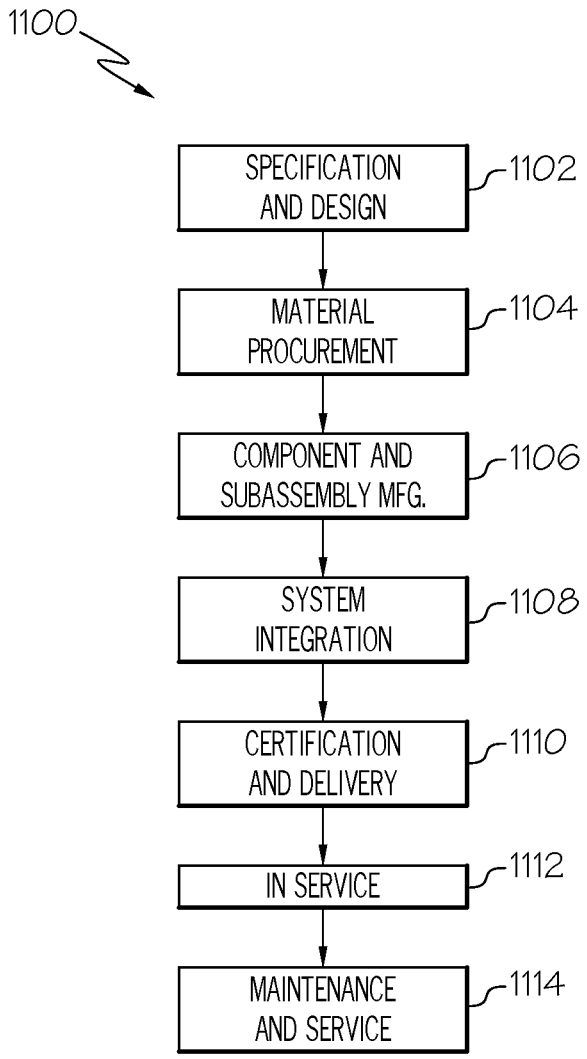
FIG. 16 is a flow diagram of an example aircraft production and service methodology.
Figure 17:
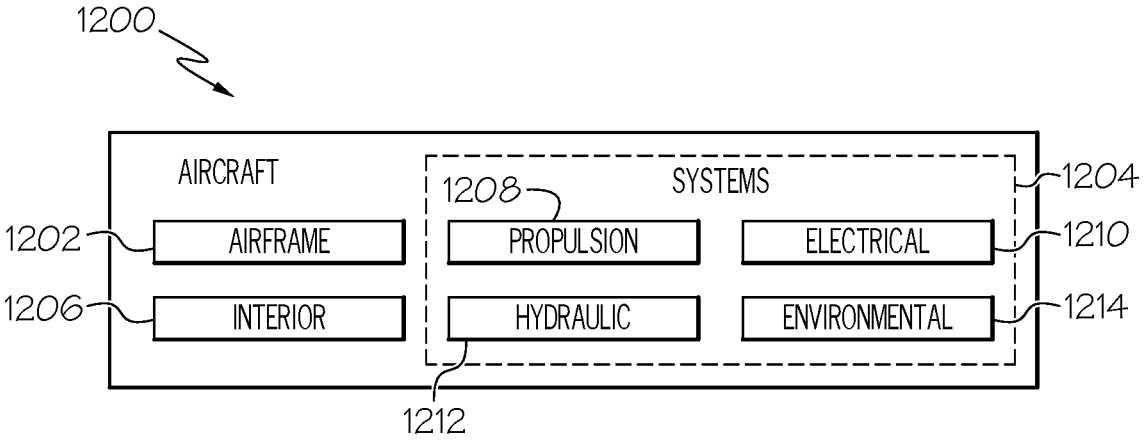
FIG. 17 is a schematic block diagram of another example of the aircraft.

Examples of the antenna 100, antenna system 126 and methods 500, 600 and 700 disclosed herein may find use in a variety of potential applications, particularly in the transportation industry, including for example, aerospace applications. Referring now to FIGS. 16 and 17, examples of the antenna 100, antenna system 126 and methods 500, 600 and 700 may be used in the context of an aircraft manufacturing and service method 1100, as shown in the flow diagram of FIG. 16, and the aircraft 1200, as shown in FIG. 17. The aircraft 1200 is an example the vehicle 134 (FIG. 8). Aircraft applications of the disclosed examples may include conformal air-filled, cavity-backed antenna systems used by the aircraft 1200 for communications and/or radar.

As shown in FIG. 16, during pre-production, the illustrative method 1100 may include specification and design of aircraft 1200, as shown at block 1102, and material procurement, as shown at block 1104. During production of the aircraft 1200, component and subassembly manufacturing, as shown at block 1106, and system integration, as shown at block 1108, of the aircraft 1200 may take place. Thereafter, the aircraft 1200 may go through certification and delivery, as shown block 1110, to be placed in service, as shown at block 1112. The disclosed antenna system 126 may be designed, manufactured (e.g., method 500) and installed as a portion of component and subassembly manufacturing (block 1106) and/or system integration (block 1108). While in service, the disclosed method 600 may be achieved utilizing the antenna system 126 to control the radiation pattern and magnitude of electromagnetic waves of the antenna 100. Routine maintenance and service may include modification, reconfiguration, refurbishment, etc. of one or more systems of the aircraft 1200.

Each of the processes of illustrative method may be performed or carried out by a system integrator, a third party, and/or an operator (e.g., a customer). For the purposes of this description, a system integrator may include, without limitation, any number of aircraft manufacturers and major-system subcontractors; a third party may include, without limitation, any number of vendors, subcontractors, and suppliers; and an operator may be an airline, leasing company, military entity, service organization, and so on.

As shown in FIG. 17, the aircraft 1200 produced by the illustrative method may include the airframe 1202, a plurality of high-level systems 1204, for example, that includes a radio communications system or radar system that utilizes the disclosed antenna 100, and an interior 1206. Other examples of the high-level systems 1204 include one or more of a propulsion system 1208, an electrical system 1210, a hydraulic system 1212 and an environmental system 1214. Any number of other systems may be included. Although an aerospace example is shown, the principles disclosed herein may be applied to other industries, such as the automotive industry, the marine industry, and the like.

Examples of the antenna, system and methods shown or described herein may be employed during any one or more of the stages of the manufacturing and service method 1100 shown in the flow diagram illustrated by FIG. 16. For example, components or subassemblies corresponding to component and subassembly manufacturing (block 1106) may be fabricated or manufactured in a manner similar to components or subassemblies produced while the aircraft 1200 is in service (block 1112). Also, one or more examples of the antenna, system, methods or combinations thereof may be utilized during production stages (blocks 1108 and 1110). Similarly, one or more examples of the antenna, system, methods or a combinations thereof, may be utilized, for example and without limitation, while the aircraft 1200 is in service (block 1112) and during maintenance and service stage (block 1114).

Reference herein to "example" means that one or more feature, structure, element, component, characteristic and/or operational step described in connection with the example is included in at least one embodiment and or implementation of the subject matter according to the present disclosure. Thus, the phrases "an example," "another example," and similar language throughout the present disclosure may, but do not necessarily, refer to the same example. Further, the subject matter characterizing any one example may, but does not necessarily, include the subject matter characterizing any other example.

As used herein, the mathematical phrase between A and B, inclusive, includes A and B. The mathematical phrase between A and B, exclusive, does not include A or B. The mathematical phrase between A, exclusive, and B, inclusive, includes B but not A.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware that enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

Unless otherwise indicated, the terms "first," "second," etc. are used herein merely as labels, and are not intended to impose ordinal, positional, or hierarchical requirements on the items to which these terms refer. Moreover, reference to a "second" item does not require or preclude the existence of lower-numbered item (e.g., a "first" item) and/or a higher-numbered item (e.g., a "third" item).

As used herein, the terms "approximately" and "about" represent an amount close to the stated amount or value that still performs the desired function or achieves the desired result. For example, the terms "approximately" and "about" may refer to an amount or value that is within less than 10% of, within less than 5% of, within less than 1% of, within less than 0.1% of, and within less than 0.01% of the stated amount or value.

As used herein, the term "substantially" may include exactly and similar, which is to an extent that it may be perceived as being exact. For illustration purposes only and not as a limiting example, the term "substantially" may be quantified as a variance of +/−5% from the exact or actual. For example, the phrase "A is substantially the same as B" may encompass embodiments where A is exactly the same as B, or where A may be within a variance of +/−5%, for example of a value, of B, or vice versa.

In FIGS. 8 and 17, referred to above, solid lines, if any, connecting various elements and/or components may represent mechanical, electrical, fluid, optical, electromagnetic and other couplings and/or combinations thereof. It will be understood that not all relationships among the various disclosed elements are necessarily represented. One or more elements shown in solid lines may be omitted from a particular example without departing from the scope of the present disclosure. Those skilled in the art will appreciate that some of the features illustrated in FIGS. 8 and 17 may be combined in various ways without the need to include other features described in FIGS. 1-7, other drawing figures, and/or the accompanying disclosure, even though such combination or combinations are not explicitly illustrated herein. Similarly, additional features not limited to the examples presented, may be combined with some or all of the features shown and described herein.

As used herein, "coupled" and "connected" mean associated directly as well as indirectly. For example, a member A may be directly associated with a member B, or may be indirectly associated therewith, e.g., via another member C. It will be understood that not all associations among the various disclosed elements are necessarily represented. Accordingly, couplings or connections other than those depicted in the figures may also exist.

In FIGS. 13-16, referred to above, the blocks may represent operations and/or portions thereof and lines connecting the various blocks do not imply any particular order or dependency of the operations or portions thereof. It will be understood that not all dependencies among the various disclosed operations are necessarily represented. FIGS. 13-16 and the accompanying disclosure describing the operations of the disclosed methods set forth herein should not be interpreted as necessarily determining a sequence in which the operations are to be performed. Rather, although one illustrative order is indicated, it is to be understood that the sequence of the operations may be modified when appropriate. Accordingly, modifications, additions and/or omissions may be made to the operations illustrated and certain operations may be performed in a different order or simultaneously. Additionally, those skilled in the art will appreciate that not all operations described need be performed.

Although various embodiments and/or examples of the disclosed antenna, aerospace vehicle and method have been shown and described, modifications may occur to those skilled in the art upon reading the specification. The present application includes such modifications and is limited only by the scope of the claims.

What is claimed is:

1. A method of making an antenna, the method comprising:

locating an antenna radiating element within a cavity opening of an antenna cavity structure, wherein the antenna radiating element is operable to emit electromagnetic radiation that has at least one wavelength;

covering the cavity opening of the antenna cavity structure with a radome structure that has an antenna window for passage of the electromagnetic radiation, wherein the radome structure comprises a foam core and a dielectric material distributed through at least a portion of the foam core; and electromagnetically coupling the radome structure with the antenna radiating element such that the antenna radiating element is dielectrically loaded by the radome structure and a depth of the antenna cavity structure is less than one-fourth of the at least one wavelength of the electromagnetic radiation emitted by the antenna radiating element.

2. The method of claim 1, further comprising:

selecting the foam core from at least one of syntactic foam and structural foam; and selecting the dielectric material from at least one of conductive microspheres, conductive particles, and conductive pins.

3. The method of claim 1, further comprising selecting the dielectric material to achieve a reduction factor that produces the depth of the antenna cavity structure of less than one-fourth of the at least one wavelength of the electromagnetic radiation, wherein the reduction factor is equal to an inverse of a square root of a product of relative permittivity of the dielectric material and relative permeability of the dielectric material.

4. The method of claim 3, further comprising selecting the dielectric material to achieve the reduction factor that produces the depth of the antenna cavity structure in a range of one-fourth, exclusive, to one-sixteenth, inclusive, of the wavelength of the electromagnetic radiation.

5. The method of claim 1 further comprising selecting the dielectric material having a dielectric constant of at least 6.25.

6. The method of claim 1, further comprising filling an antenna cavity of the antenna cavity structure with a low-dielectric material that has a dielectric constant in a range of 1.0 to 1.1.

7. The method of claim 6, further comprising selecting the low-dielectric material from at least one of air, vacuum, and open cell foam.

8. A method of making an antenna system for a vehicle, the method comprising:

locating an antenna radiating element within a cavity opening of an antenna cavity structure, wherein the antenna radiating element is operable to emit electromagnetic radiation that has at least one wavelength;

coupling a radio module to the antenna radiating element;

covering the cavity opening of the antenna cavity structure with a radome structure that has an antenna window for passage of the electromagnetic radiation, wherein the radome structure comprises a foam core and a dielectric material distributed through at least a portion of the foam core;

electromagnetically coupling the radome structure with the antenna radiating element such that the antenna radiating element is dielectrically loaded by the radome structure and a depth of the antenna cavity structure is less than one-fourth of the at least one wavelength of the electromagnetic radiation emitted by the antenna radiating element; and coupling the radome structure to at least one of a plurality of panels to form a skin of the vehicle.

9. The method of claim 8, further comprising coupling a current diverter to the foam core of the radome structure.

10. The method of claim 8, further comprising:

selecting the foam core from at least one of syntactic foam and structural foam; and selecting the dielectric material from at least one of conductive microspheres, conductive particles, and conductive pins.

11. The method of claim 8, wherein the radome structure further comprises a face sheet connected to a surface of the foam core, wherein the face sheet comprises a fiber-reinforced polymer.

12. The method of claim 8, further comprising selecting the dielectric material to achieve a reduction factor that produces the depth of the antenna cavity structure of less than one-fourth of the at least one wavelength of the electromagnetic radiation, wherein the reduction factor is equal to an inverse of a square root of a product of relative permittivity of the dielectric material and relative permeability of the dielectric material.

13. The method of claim 8 further comprising selecting the dielectric material having a dielectric constant of at least 6.25.

14. The method of claim 8, further comprising filling an antenna cavity of the antenna cavity structure with a low-dielectric material that has a dielectric constant in a range of 1.0 to 1.1.

15. The method of claim 1, further comprising:

defining an operating frequency of the antenna radiating element to be located within the antenna cavity structure;

determining a non-loaded depth of the antenna cavity structure;

determining a reduced depth of the antenna cavity structure that is less than one-fourth of the at least one wavelength;

determining a reduction factor to reduce the non-loaded depth to the reduced depth; and selecting the dielectric material, for distribution through at least a portion of the foam core forming the radome structure, to achieve the reduction factor.

16. The method of claim 15, wherein:

the dielectric material has a relative permittivity and a relative permeability; and the reduction factor is equal to an inverse of a square root of a product of the relative permittivity and the relative permeability of the dielectric material.

17. The method of claim 15, wherein the reduced depth of the antenna cavity structure is between one-fourth, exclusive, and one-sixteenth, inclusive, of the at least one wavelength.

18. The method of claim 17 further comprising determining the distribution of the dielectric material within at least a portion of the foam core of the radome structure to achieve the reduction factor, wherein the dielectric material is selected from conductive microspheres, conductive particles, and conductive pins.

19. The method of claim 18, wherein selection and distribution of the dielectric material is a function of the at least one wavelength such that the radome structure is electromagnetically coupled with and dielectrically loads the antenna radiating element.

20. The method of claim 17, wherein the dielectric material is selected such that the antenna window, formed in the radome structure for passage of the electromagnetic radiation, has a dielectric constant of at least 6.25.

* * * * *